US008678111B2

(12) United States Patent
Zahradnik et al.

(10) Patent No.: US 8,678,111 B2
(45) Date of Patent: Mar. 25, 2014

(54) HYBRID DRILL BIT AND DESIGN METHOD

(75) Inventors: Anton F. Zahradnik, Sugarland, TX (US); Rudolf Carl Pessier, Galveston, TX (US); Don Q. Nguyen, Houston, TX (US); Matthew J. Meiners, Spring, TX (US); Karlos B. Cepeda, Fort Worth, TX (US); Michael S. Damschen, Houston, TX (US); Mark P. Blackman, Spring, TX (US); Jack T. Oldham, Conroe, TX (US); Ronny D. McCormick, Magnolia, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/271,033

(22) Filed: Nov. 14, 2008

(65) Prior Publication Data

US 2009/0126998 A1 May 21, 2009

Related U.S. Application Data

(60) Provisional application No. 60/988,718, filed on Nov. 16, 2007.

(51) Int. Cl.
*E21B 10/14* (2006.01)
*E21B 10/16* (2006.01)

(52) U.S. Cl.
CPC ..... *E21B 10/14* (2013.01); *E21B 10/16* (2013.01)
USPC ..... 175/336; 175/431

(58) Field of Classification Search
USPC ..... 175/57, 336, 335, 376
See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |
| 1,394,769 | A | 10/1921 | Sorensen |
| 1,519,641 | A | 12/1924 | Thompson |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |
| 1,932,487 | A | 10/1933 | Scott |

(Continued)

FOREIGN PATENT DOCUMENTS

| | | |
|---|---|---|
| DE | 13 01 784 | 8/1969 |
| EP | 0225101 | 6/1987 |

(Continued)

OTHER PUBLICATIONS

Williams, J.L. and Thompson, A.I., "An Analysis of the Performance of PDC Hybrid Drill Bits", SPE IADC Paper No. 16117, pp. 585-594, 1987.

(Continued)

*Primary Examiner* — Cathleen Hutchins
(74) *Attorney, Agent, or Firm* — Sutton McAughan Deaver, PLLC

(57) ABSTRACT

A hybrid earth-boring bit comprising a bit body having a central axis, at least one, preferably three fixed blades, depending downwardly from the bit body, each fixed blade having a leading edge, and at least one rolling cutter, preferably three rolling cutters, mounted for rotation on the bit body. A rolling cutter is located between two fixed blades.

46 Claims, 12 Drawing Sheets

(56) References Cited

U.S. PATENT DOCUMENTS 2,030,722 A 2/1936 Scott
2,117,481 A 5/1938 Howard et al.
2,119,618 A 6/1938 Zublin
2,198,849 A 4/1940 Waxier
2,216,894 A 10/1940 Stancliff
2,244,537 A 6/1941 Kammerer
2,297,157 A 9/1942 McClinton
2,320,136 A 5/1943 Kammerer
2,320,137 A 5/1943 Kammerer
2,380,112 A 7/1945 Kinnear
RE23,416 E 10/1951 Kinnear
2,719,026 A 9/1955 Boice
2,815,932 A 12/1957 Wolfram
2,994,389 A 8/1961 Bus, Sr.
3,010,708 A 11/1961 Hlinsky et al.
3,050,293 A 8/1962 Hlinsky
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Raymond
3,250,337 A 5/1966 Demo
3,269,469 A 8/1966 Kelly, Jr.
3,387,673 A 6/1968 Thompson
3,424,258 A 1/1969 Nakayama
3,583,501 A 6/1971 Aalund
RE28,625 E 11/1975 Cunningham
4,006,788 A 2/1977 Garner
4,140,189 A 2/1979 Garner
4,190,126 A 2/1980 Kabashima
4,270,812 A 6/1981 Thomas
4,285,409 A 8/1981 Allen
4,293,048 A 10/1981 Kloesel, Jr.
4,320,808 A 3/1982 Garrett
4,343,371 A 8/1982 Baker, III et al.
4,359,112 A 11/1982 Garner et al.
4,369,849 A 1/1983 Parrish
4,386,669 A 6/1983 Evans
4,410,284 A 10/1983 Herrick
4,428,687 A 1/1984 Zahradnik
4,444,281 A 4/1984 Schumacher, Jr. et al.
4,527,637 A 7/1985 Bodine
4,572,306 A 2/1986 Dorosz
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,738,322 A 4/1988 Hall et al.
4,765,205 A 8/1988 Higdon
4,874,047 A 10/1989 Hixon
4,875,532 A 10/1989 Langford, Jr.
4,892,159 A 1/1990 Holster
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts
4,981,184 A * 1/1991 Knowlton et al. ..... 175/429
4,984,643 A 1/1991 Isbell et al.
4,991,671 A 2/1991 Pearce et al.
5,016,718 A 5/1991 Tandberg
5,027,912 A 7/1991 Juergens
5,028,177 A 7/1991 Meskin et al.
5,030,276 A 7/1991 Sung et al.
5,049,164 A 9/1991 Horton et al.
5,116,568 A 5/1992 Sung et al.
5,145,017 A 9/1992 Holster et al.
5,176,212 A 1/1993 Tandberg
5,224,560 A 7/1993 Fernandez
5,238,074 A 8/1993 Tibbitts et al.
5,287,936 A 2/1994 Grimes et al.
5,289,889 A 3/1994 Gearhart et al.
5,337,843 A 8/1994 Torgrimsen et al.
5,346,026 A 9/1994 Pessier et al.
5,351,770 A 10/1994 Cawthorne et al.
5,361,859 A 11/1994 Tibbitts
5,429,200 A 7/1995 Blackman et al.
5,439,068 A 8/1995 Huffstutler et al.
5,452,771 A 9/1995 Blackman et al.
5,467,836 A 11/1995 Grimes et al.
5,472,057 A 12/1995 Winfree
5,472,271 A 12/1995 Bowers et al.
5,513,715 A 5/1996 Dysart
5,518,077 A 5/1996 Blackman et al.
5,531,281 A * 7/1996 Murdock ..... 175/431
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,695,018 A 12/1997 Pessier et al.
5,695,019 A 12/1997 Shamburger, Jr.
5,755,297 A 5/1998 Young et al.
5,862,871 A 1/1999 Curlett
5,868,502 A 2/1999 Cariveau et al.
5,873,422 A 2/1999 Hansen et al.
5,941,322 A 8/1999 Stephenson et al.
5,944,125 A 8/1999 Byrd
5,967,246 A 10/1999 Caraway et al.
5,979,576 A 11/1999 Hansen et al.
5,988,303 A 11/1999 Arfele
5,992,542 A 11/1999 Rives
5,996,713 A 12/1999 Pessier et al.
6,092,613 A 7/2000 Caraway et al.
6,095,265 A 8/2000 Alsup
6,109,375 A 8/2000 Tso
6,116,357 A 9/2000 Wagoner et al.
6,173,797 B1 1/2001 Dykstra et al.
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 * 2/2002 Siracki ..... 175/353
6,360,831 B1 3/2002 Akesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,439,326 B1 8/2002 Huang et al.
6,446,739 B1 9/2002 Richman et al.
6,450,270 B1 9/2002 Saxton
6,460,635 B1 10/2002 Kalsi et al.
6,474,424 B1 11/2002 Saxman
6,510,906 B1 1/2003 Richert et al.
6,510,909 B2 1/2003 Portwood et al.
6,527,066 B1 3/2003 Rives
6,533,051 B1 3/2003 Singh et al.
6,544,308 B2 4/2003 Griffin et al.
6,562,462 B2 5/2003 Griffin et al.
6,568,490 B1 5/2003 Tso et al.
6,581,700 B2 6/2003 Curlett et al.
6,585,064 B2 7/2003 Griffin et al.
6,589,640 B2 7/2003 Griffin et al.
6,592,985 B2 7/2003 Griffin et al.
6,601,661 B2 8/2003 Baker et al.
6,601,662 B2 8/2003 Matthias et al.

(56) References Cited

U.S. PATENT DOCUMENTS

| | | | |
|---|---|---|---|
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |
| 6,797,326 | B2 | 9/2004 | Griffin et al. |
| 6,823,951 | B2 | 11/2004 | Yong et al. |
| 6,843,333 | B2 | 1/2005 | Richert et al. |
| 6,861,098 | B2 | 3/2005 | Griffin et al. |
| 6,861,137 | B2 | 3/2005 | Griffin et al. |
| 6,878,447 | B2 | 4/2005 | Griffin et al. |
| 6,883,623 | B2 | 4/2005 | McCormick et al. |
| 6,902,014 | B1 | 6/2005 | Estes |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,137,460 | B2 | 11/2006 | Slaughter, Jr. et al. |
| 7,152,702 | B1 | 12/2006 | Bhome et al. |
| 7,197,806 | B2 | 4/2007 | Boudreaux et al. |
| 7,198,119 | B1 | 4/2007 | Hall et al. |
| 7,234,550 | B2 | 6/2007 | Azar et al. |
| 7,270,196 | B2 | 9/2007 | Hall |
| 7,281,592 | B2 | 10/2007 | Runia et al. |
| 7,320,375 | B2 | 1/2008 | Singh |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |
| 7,416,036 | B2 | 8/2008 | Forstner et al. |
| 7,435,478 | B2 | 10/2008 | Keshavan |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,517,589 | B2 | 4/2009 | Eyre |
| 7,533,740 | B2 | 5/2009 | Zhang et al. |
| 7,568,534 | B2 | 8/2009 | Griffin et al. |
| 7,621,346 | B1 | 11/2009 | Trinh et al. |
| 7,621,348 | B2 | 11/2009 | Hoffmaster et al. |
| 7,703,556 | B2 | 4/2010 | Smith et al. |
| 7,703,557 | B2 | 4/2010 | Durairajan et al. |
| 7,819,208 | B2 | 10/2010 | Pessier et al. |
| 7,836,975 | B2 | 11/2010 | Chen et al. |
| 7,845,435 | B2 | 12/2010 | Zahradnik et al. |
| 7,845,437 | B2 | 12/2010 | Bielawa et al. |
| 7,847,437 | B2 | 12/2010 | Chakrabarti et al. |
| 2002/0092684 | A1 | 7/2002 | Singh et al. |
| 2002/0108785 | A1 | 8/2002 | Slaughter, Jr. et al. |
| 2004/0099448 | A1 | 5/2004 | Fielder et al. |
| 2004/0238224 | A1 | 12/2004 | Runia |
| 2005/0087370 | A1 | 4/2005 | Ledgerwood, III et al. |
| 2005/0103533 | A1 | 5/2005 | Sherwood, Jr. et al. |
| 2005/0178587 | A1 | 8/2005 | Witman, IV et al. |
| 2005/0183892 | A1 | 8/2005 | Oldham et al. |
| 2005/0263328 | A1 | 12/2005 | Middlemiss |
| 2005/0273301 | A1 | 12/2005 | Huang |
| 2006/0032674 | A1 | 2/2006 | Chen et al. |
| 2006/0032677 | A1 | 2/2006 | Azar et al. |
| 2006/0162969 | A1 | 7/2006 | Belnap et al. |
| 2006/0196699 | A1 | 9/2006 | Estes et al. |
| 2006/0254830 | A1 | 11/2006 | Radtke |
| 2006/0266558 | A1 | 11/2006 | Middlemiss et al. |
| 2006/0266559 | A1 | 11/2006 | Keshavan et al. |
| 2006/0278442 | A1 | 12/2006 | Kristensen |
| 2006/0283640 | A1 | 12/2006 | Estes et al. |
| 2007/0029114 | A1 | 2/2007 | Middlemiss |
| 2007/0062736 | A1 | 3/2007 | Cariveau et al. |
| 2007/0079994 | A1 | 4/2007 | Middlemiss |
| 2007/0187155 | A1 | 8/2007 | Middlemiss |
| 2007/0221417 | A1 | 9/2007 | Hall et al. |
| 2008/0066970 | A1 | 3/2008 | Zahradnik et al. |
| 2008/0264695 | A1 | 10/2008 | Zahradnik et al. |
| 2008/0296068 | A1 | 12/2008 | Zahradnik et al. |
| 2009/0114454 | A1 | 5/2009 | Belnap et al. |
| 2009/0120693 | A1 | 5/2009 | McClain et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0183925 | A1 | 7/2009 | Zhang et al. |
| 2009/0272582 | A1 | 11/2009 | McCormick et al. |
| 2010/0224417 | A1 | 9/2010 | Zahradnik et al. |
| 2010/0276205 | A1 | 11/2010 | Oxford et al. |
| 2010/0288561 | A1 | 11/2010 | Zahradnik et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1 | 4/2011 | Buske et al. |
| 2011/0079443 | A1 | 4/2011 | Buske et al. |
| 2011/0162893 | A1 | 7/2011 | Zhang |

FOREIGN PATENT DOCUMENTS

| | | |
|---|---|---|
| EP | 0157278 | 11/1989 |
| EP | 0391683 | 1/1996 |
| EP | 0874128 | 10/1998 |
| EP | 2089187 | 8/2009 |
| GB | 2 183 694 A | 6/1987 |
| GB | 2183694 | 6/1987 |
| JP | 2000080878 | 3/2000 |
| JP | 2001159289 | 6/2001 |
| SU | 1 331 988 | 8/1987 |
| WO | 85/02223 A1 | 5/1985 |
| WO | 8502223 | 5/1985 |
| WO | 2008124572 | 10/2008 |

OTHER PUBLICATIONS

Ersoy, A., and Waller, M.D., "Wear Characteristics of PDC Pin and Hybrid Core Bits in Rock Drilling", Wear, vol. 188 (Issue 1-2 ), pp. 150-165 (Sep. 1995).

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

International Search Report for corresponding International patent application No. PCT/US2008/083532, mailed on Feb. 25, 2009.

Written Opinion for corresponding International patent application No. PCT/US2008/083532, mailed on Feb. 25, 2009.

International Search Report for corresponding International patent application No. PCT/US2008/083532.

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins—New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

(56) References Cited

OTHER PUBLICATIONS

Ersoy, A. and Waller, M. "Wear characteristics of PDC pin and hybrid core bits in rock drilling." Wear 188, Elsevier Science S.A., Mar. 1995, pp. 150-165.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.

B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.

Beijer, G., International Preliminary Report on Patentability for International Patent Application No. PCT/US2009/042514, The International Bureau of WIPO, dated Nov. 2, 2010.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

Georgescu, M., International Search Report for International Patent Application No. PCT/US2010/051019, dated Jun. 6, 2011, European Patent Office.

Georgescu, M., Written Opinion for International Patent Application No. PCT/US2010/051019, dated Jun. 6, 2011, European Patent Office.

Georgescu, M., International Search Report for International Patent Application No. PCT/US2010/051020, dated Jun. 1, 2011, European Patent Office.

Georgescu, M., Written Opinion for International Patent Application No. PCT/US2010/051020, dated Jun. 1, 2011, European Patent Office.

Georgescu, M., International Search Report for International Patent Application No. PCT/US2010/051017, dated Jun. 8, 2011, European Patent Office.

Georgescu, M., Written Opinion for International Patent Application No. PCT/US2010/051017, dated Jun. 8, 2011, European Patent Office.

Georgescu, M., International Search Report for International Patent Application No. PCT/US2010/051014, dated Jun. 9, 2011, European Patent Office.

Georgescu, M., Written Opinion for International Patent Application No. PCT/US2010/051014, dated Jun. 9, 2011, European Patent Office.

Georgescu, M., International Search Report for International Patent Application No. PCT/US2010/050631, dated Jun. 10, 2011, European Patent Office.

Georgescu, M., Written Opinion for International Patent Application No. PCT/US2010/050631, dated Jun. 10, 2011, European Patent Office.

Kang, K.H., International Search Report for International Patent Application No. PCT/US2010/033513, Korean Intellectual Property Office, dated Jan. 10, 2011.

Kang, K.H., Written Opinion for International Patent Application No. PCT/US2010/033513, Korean Intellectual Property Office, dated Jan. 10, 2011.

Kang, M.S., International Search Report for International Patent Application No. PCT/US2010/032511, Korean Intellectual Property Office, dated Jan. 17, 2011.

Kang, M.S., Written Opinion for International Patent Application No. PCT/US2010/032511, Korean Intellectual Property Office, dated Jan. 17, 2011.

Choi, J.S., International Search Report for International Patent Application No. PCT/US2010/039100, Korean Intellectual Property Office, dated Jan. 25, 2011.

Choi, J.S., Written Opinion for International Patent Application No. PCT/US2010/039100, Korean Intellectual Property Office, dated Jan. 25, 2011.

Baharlou, S., International Preliminary Report on Patentability, The International Bureau of WIPO, dated Jan. 25, 2011.

Becamel, P., International Preliminary Report on Patentability, dated Jan. 5, 2012, The International Bureau of WIPO, Switzerland.

* cited by examiner

HYBRID DRILL BIT AND DESIGN METHOD

CROSS-REFERENCE TO RELATED APPLICATIONS

This application claims the benefit of U.S. provisional patent application Ser. No. 60/988,718, filed Nov. 16, 2007, which is incorporated herein in its entirety. This application is related to application Ser. No. 12/061,536, filed Apr. 2, 2008, which is incorporated herein in its entirety.

BACKGROUND OF THE INVENTION

1. Technical Field

The present invention relates in general to earth-boring bits and, in particular, to an improved bit having a combination of rolling-cutters and fixed cutters and cutting elements and a method of design and operation of such bits.

2. Description of the Related Art

The success of rotary drilling enabled the discovery of deep oil and gas reservoirs and production of enormous quantities of oil. The rotary rock bit was an important invention that made the success of rotary drilling possible. Only soft earthen formations could be penetrated commercially with the earlier drag bit and cable tool, but the two-cone rock bit, invented by Howard R. Hughes, U.S. Pat. No. 930,759, drilled the caprock at the Spindletop field near Beaumont, Tex., with relative ease. That venerable invention, within the first decade of the last century, could drill a scant fraction of the depth and speed of the modern rotary rock bit. The original Hughes bit drilled for hours; the modern bit now drills for days. Modern bits sometimes drill for thousands of feet instead of merely a few feet. Many advances have contributed to the impressive improvements in rotary rock bits.

In drilling boreholes in earthen formations using rolling-cone or rolling-cutter bits, rock bits having one, two, or three rolling cutters rotatably mounted thereon are employed. The bit is secured to the lower end of a drill string that is rotated from the surface or by downhole motors or turbines. The cutters mounted on the bit roll and slide upon the bottom of the borehole as the drill string is rotated, thereby engaging and disintegrating the formation material to be removed. The rolling-cutters are provided with cutting elements or teeth that are forced to penetrate and gouge the bottom of the borehole by weight from the drill string. The cuttings from the bottom and sides of the borehole are washed away and disposed by drilling fluid that is pumped down from the surface through the hollow, rotating drill string, and the nozzles as orifices on the drill bit. Eventually the cuttings are carried in suspension in the drilling fluid to the surface up the exterior of the drill string.

Rolling-cutter bits dominated petroleum drilling for the greater part of the $20^{th}$ century. With improvements in synthetic diamond technology that occurred in the 1970s and 1980s, the fixed blade cutter bit or drag bit became popular again in the latter part of the $20^{th}$ century. Modern fixed blade cutter bits are often referred to as "diamond" or "PDC" (polycrystalline diamond cutter bits) bits and are far removed from the original fixed bladecutter bits of the $19^{th}$ and early $20^{th}$ centuries. Diamond or PDC bits carry cutting elements comprising polycrystalline diamond compact layers or "tables" formed on and bonded to a supporting substrate, conventionally of cemented tungsten carbide, the cutting element being arranged in selected location on blades or other structures on the bit body with the diamond tables facing generally in the direction of bit rotation. Fixed blade cutter bits have the advantage of being much more aggressive during drilling and therefore drill much faster at equivalent weight-on-bit levels (WOB) than, for instance, a rolling-cutter bit. In addition, they have no moving parts, which make their design less complex and more robust. The drilling mechanics and dynamics of fixed blade cutter bits are different from those of rolling-cutter bits precisely because they are more aggressive in cutting and require more torque to rotate during drilling. During a drilling operation, fixed blade cutter bits are used in a manner similar to that for rolling-cutter bits, the fixed blade cutter bits also being rotated against a formation being drilled under applied weight-on-bit to remove formation material. The cutting elements on the fixed blade cutters are continuously engaged as they scrape material from the formation, while in a rolling-cutter bit the cutting elements on each rolling cutter indent the formation intermittently with little or no relative motion (scraping) between the cutting element and the formation. A rolling-cutter bit and a fixed blade cutter bit each have particular applications for which they are more suitable than the other. The much more aggressive fixed blade cutter bit is superior in drilling in a softer formation to a medium hard formation while the rolling-cutter bit excels in drilling hard formations, abrasive formations, or any combination thereof.

In the prior art, some earth-boring bits use a combination of one or more rolling cutters and one or more fixed blade cutters. Some of these combination-type drill bits are referred to as hybrid bits. Previous designs of hybrid bits, such as U.S. Pat. No. 4,343,371, to Baker, III, have used rolling-cutters to do most of the formation cutting, especially in the center of the hole or bit. Another type of hybrid bit is described in U.S. Pat. No. 4,444,281, to Schumacher, has equal numbers of fixed blade cutters and rolling-cutters in essentially symmetrical arrangements. In such bits, the rolling-cutters do most of the cutting of the formation while the fixed blade cutters act as scrapers to remove uncut formation indentations left by the rolling-cutters as well as cuttings left behind by the rolling-cutters. While such a hybrid bit improves the cutting efficiency of the hybrid bit over that of a rolling-cutter bit in softer formations, it has only a small or marginal effect on improving the overall performance in harder formations. When comparing a fixed blade cutter bit to a rolling-cutter bit, the high cutting aggressiveness of a fixed blade cutter bit frequently causes such bit to reach the torque capacity or limit of a conventional rotary table drilling systems or motors, even at a moderate level of weight-on-bit during drilling, particularly on larger diameter drill bits. The reduced cutting aggressiveness of a rolling-cutter bit, on the other hand, frequently causes the rolling-cutter bit to exceed the weight-on-bit limits of the drill string before reaching the full torque capacity of a conventional rotary table drive drilling system.

None of the prior art addresses the large difference in cutting aggressiveness between rolling-cutter bits and fixed blade cutter bits. Accordingly, an improved hybrid bit with adjustable cutting aggressiveness that falls between or midway between the cutting aggressiveness of a rolling-cutter bit and a fixed blade cutter bit would be desirable.

SUMMARY OF THE INVENTION

A hybrid earth-boring bit comprising a bit body having a central axis, at least one, preferably three fixed blade cutters, depending downwardly from the bit body, each fixed blade cutter having a leading edge, and at least one rolling-cutter, preferably three rolling-cutters, mounted for rotation on the bit body. A fixed blade cutter and a rolling-cutter forming a pair of cutters on the hybrid bit body. When there are three rolling-cutters, each rolling-cutter is located between two fixed blade cutters.

A plurality of cutting elements is arranged on the leading edge of each fixed blade cutter and a plurality of cutting elements is arranged on each of the rolling-cutters. The rolling-cutters each have cutting elements arranged to engage formation in the same swath or kerf or groove as a matching cutting element on a fixed blade cutter. In the pair of cutters, the matching fixed blade cutter being arranged to be either trailing, leading, or opposite the rolling-cutter to adapt the hybrid bit to the application by modifying the cutting aggressiveness thereof to get the best balance between the rate-of penetration of the bit and the durability of the bit for the pair of cutters.

A method for designing a hybrid earth-boring bit of the present invention permits or allows the cutting aggressiveness of a hybrid bit to be adjusted or selected based on the relationship of at least a pair of cutters comprising a fixed blade cutter and a rolling-cutter, of a plurality of fixed blade cutters and rolling-cutters, wherein the relationship includes a fixed blade cutter leading a rolling-cutter in a pair of cutters, a rolling cutter leading a fixed blade cutter in a pair of cutters, a rolling-cutter being located opposite a fixed blade cutter in a pair of cutters on the bit, and the angular relationship of a fixed blade cutter and a rolling-cutter of a pair of cutters regarding the amount of leading or trailing of the cutter from an associated cutter of the pair of cutters. The cutting aggressiveness of a hybrid bit of the present invention being achieved by defining a cutting aggressiveness of a hybrid drill bit and the various combinations of pairs of a fixed blade cutters and a rolling-cutters, when compared to each other and to different types of drill bits, such as a rolling-cutter drill bit and a fixed blade cutter drill bit, either as the ratio of torque to weight-on-bit or as the ratio of penetration rate to weight-on-bit. The cutting aggressiveness for a hybrid bit of the present invention being adjusted by performing at least one of the following steps:

- adjusting the angular distance between each rolling-cutter and each fixed blade cutter of a pair of cutters of the bit;
- adjusting the effective projection of the cutting elements on a rolling cutter;
- arranging the cutting elements of a fixed blade cutter and the cutting elements of a rolling-cutter so that at least one cutting element of a rolling-cutter and at least one cutting element of a fixed blade cutter cut the same swath or kerf or groove during a drilling operation; and
- arranging a pair of at least one fixed blade cutter and a rolling-cutter so that the rolling cutter either leads the fixed blade cutter [(<180°) angular distance], the rolling-cutter opposes the fixed blade cutter [(=180°) angular distance], or trails the fixed blade cutter [(>180°) angular distance].

Other features and advantages of the present invention become apparent with reference to the drawings and detailed description of the invention.

DETAILED DESCRIPTION OF THE INVENTION

Figure 1:
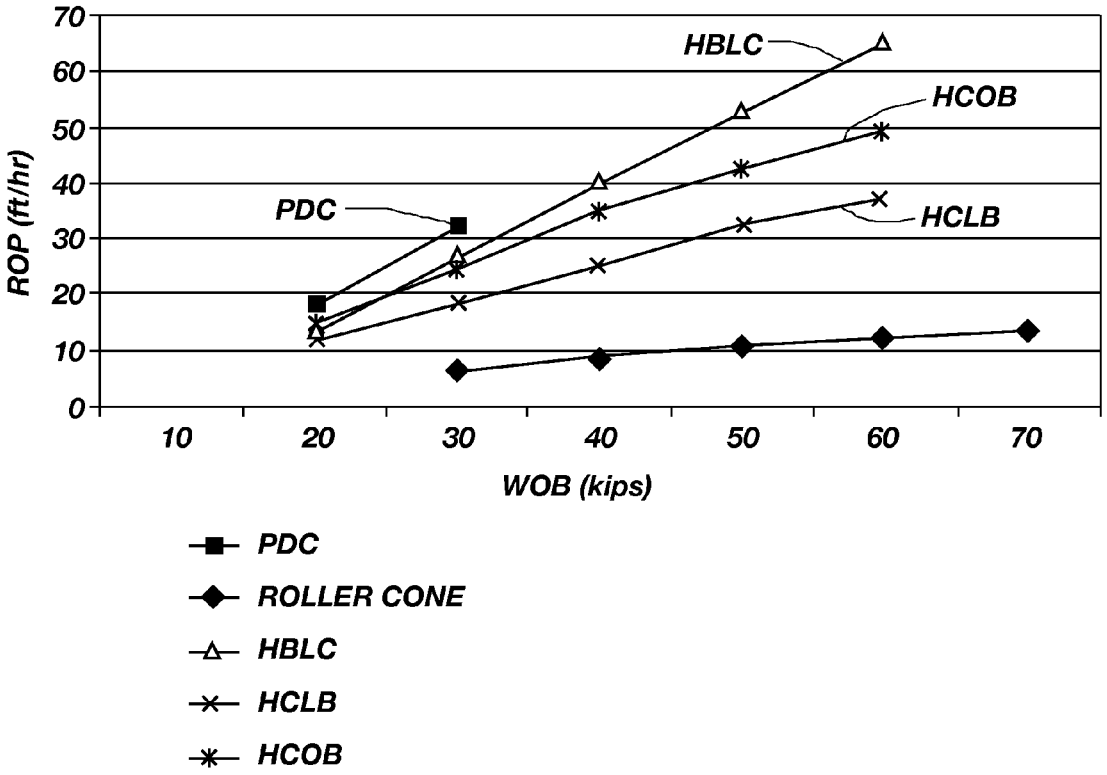
FIG. 1 is a graph illustrating the relative aggressiveness of a rolling-cutter bit, a fixed blade cutter bit having polycrystalline diamond cutters or PDC bit, and embodiments of hybrid bits of the present inventions.

Turning now to the drawing figures, and particularly to FIG. 1, the characteristics of various embodiments of the present invention are described. FIG. 1 is a graph of rate-of-penetration (ROP on y-axis) versus weight-on-bit (WOB on x-axis) for earth-boring bits such as a fixed blade cutter bit, a hybrid bit of the present invention, and a three rolling-cutter bit (three roller cone bit). The data for the bits illustrated in the graph was generated using 12¼/inch bits on the Hughes Christensen simulator in The Woodlands, Tex. The conditions were 4000 pounds per square inch of bottom-hole pressure, 120 bit revolutions per minute, and 9.5 pounds per gallon drilling fluid or mud while drilling Carthage marble. The data used and reflected in FIG. 1 is intended to be general and to reflect general characteristics for the three types of bits, such as fixed blade cutter bits having PDC cutting elements, hybrid bits including variations thereof of the present inventions, and rolling-cutter bits (roller cone bits) whose cutting aggressiveness characteristics are illustrated.

The graph shows the performance characteristics of three different types of earth-boring bits: a three rolling-cutter bit (three roller cones), a six blade fixed cutter bit having PDC cutting elements, and a "hybrid" bit having both (three) rolling-cutters and (three) fixed blade cutters. As shown, each type of bit has a characteristic line. The six fixed blade cutter bit having PDC cutting elements has the highest ROP for a given WOB resulting in a line having the steepest slope of the line showing cutting performance of the bit. However, the PDC bit could not be run at high weight on bit because of high vibrations of the bit. The three rolling-cutter bit (three roller cone bit) has the lowest ROP for a given WOB resulting in a line having the shallowest slope of the line showing cutting performance of the bit. The hybrid bit in the three embodiments of the present invention exhibits intermediate ROP for a given WOB resulting in lines having an intermediate slopes of the lines showing cutting performance of the bit between the lines for the fixed blade cutter bit and the three rolling-cutter bit.

The slope of the line (curve) plotted for ROP versus WOB for a given bit can be termed or defined as the bit's cutting aggressiveness or simply "Aggressiveness" as used herein. "Aggressiveness," for purposes of this application and the inventions described herein, is defined as follows:

$$\text{Aggressiveness}=\text{Rate of Penetration (ROP)}/\text{Weight on Bit (WOB)} \quad (1)$$

Thus aggressiveness, as the mathematical slope of a line, has a value greater than zero. Measured purely in terms of aggressiveness, it would seem that fixed blade cutter bits would be selected in all instances for drilling. However, other factors come into play. For example, there are limits on the amount of WOB and torque to turn the bit that can be applied, generally based on either the drilling application or the capacity of the drill string and drilling rig. For example, as WOB on a fixed blade cutter bit increases the drill string torque requirement increase rapidly, especially with fixed blade cutter bits, and erratic torque can cause harmful vibrations. Rolling-cutter bits, on the other hand, require high WOB which, in the extreme, may buckle a bottom hole assembly or exceed the load bearing capacity of the cutter bearings of the rolling-cutters of the rolling-cutter bit. Accordingly, different types of bits, whether a fixed blade cutter bit, a rolling-cutter bit, or a hybrid bit, have different advantages in different situations. One aspect of the present invention is to provide a method for the design of a hybrid earth-boring bit so that its aggressiveness characteristics can be tailored or varied to the drilling application.

Figure 2:
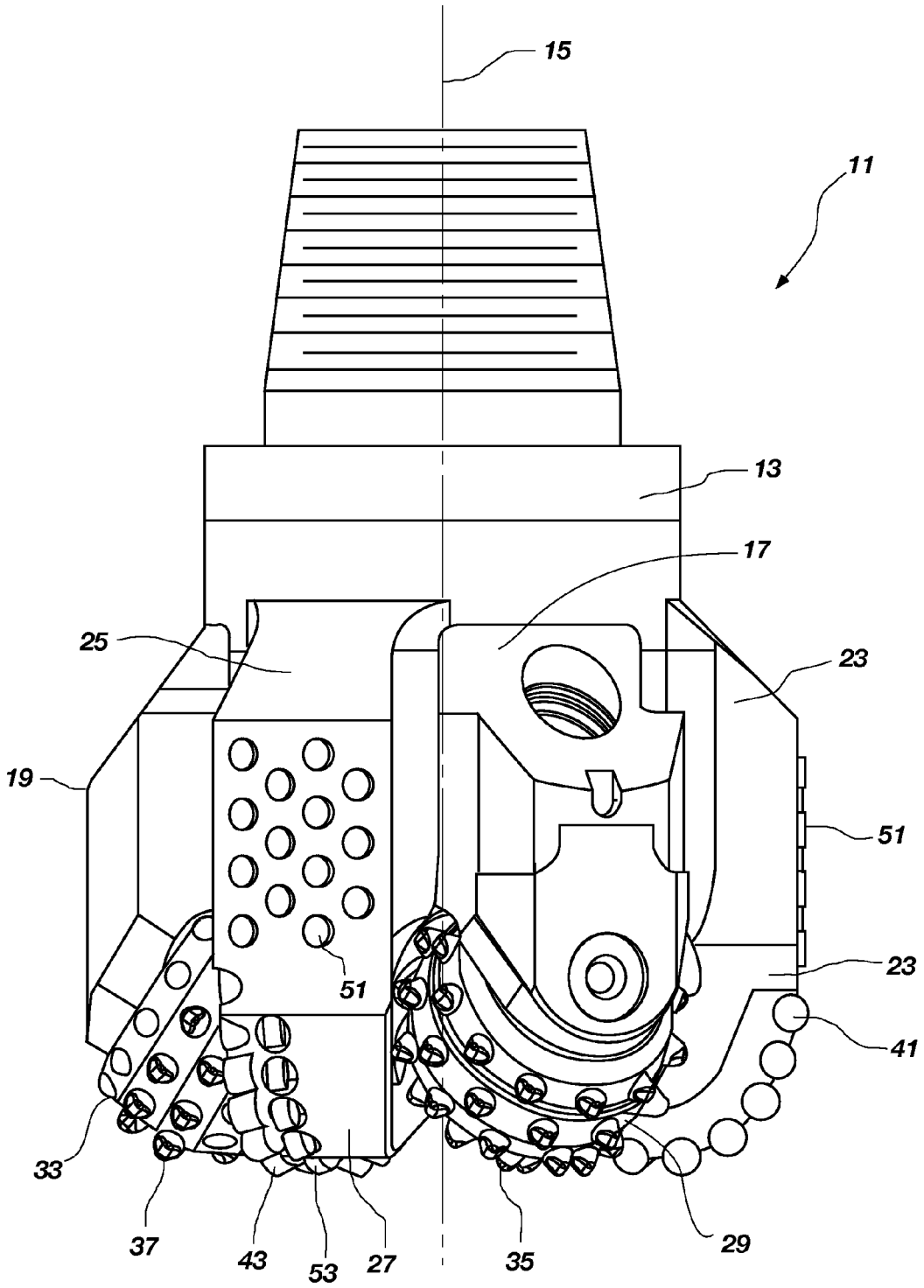
FIG. 2 is an elevation view of a hybrid earth-boring bit illustrative of the present invention.
Figure 3:
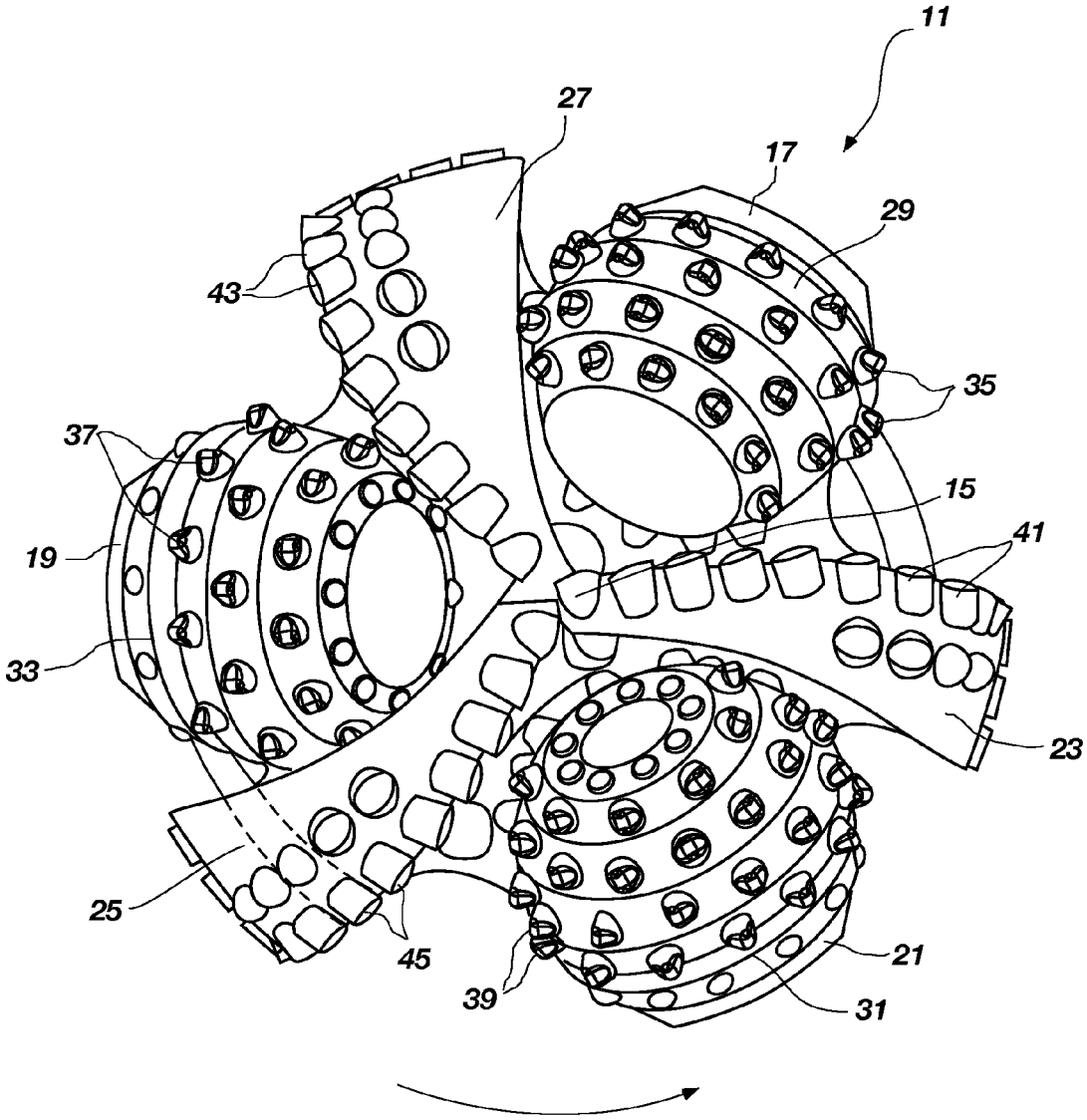
FIG. 3 is a bottom plan form view of the hybrid earth-boring bit of FIG. 2.
Figure 4:
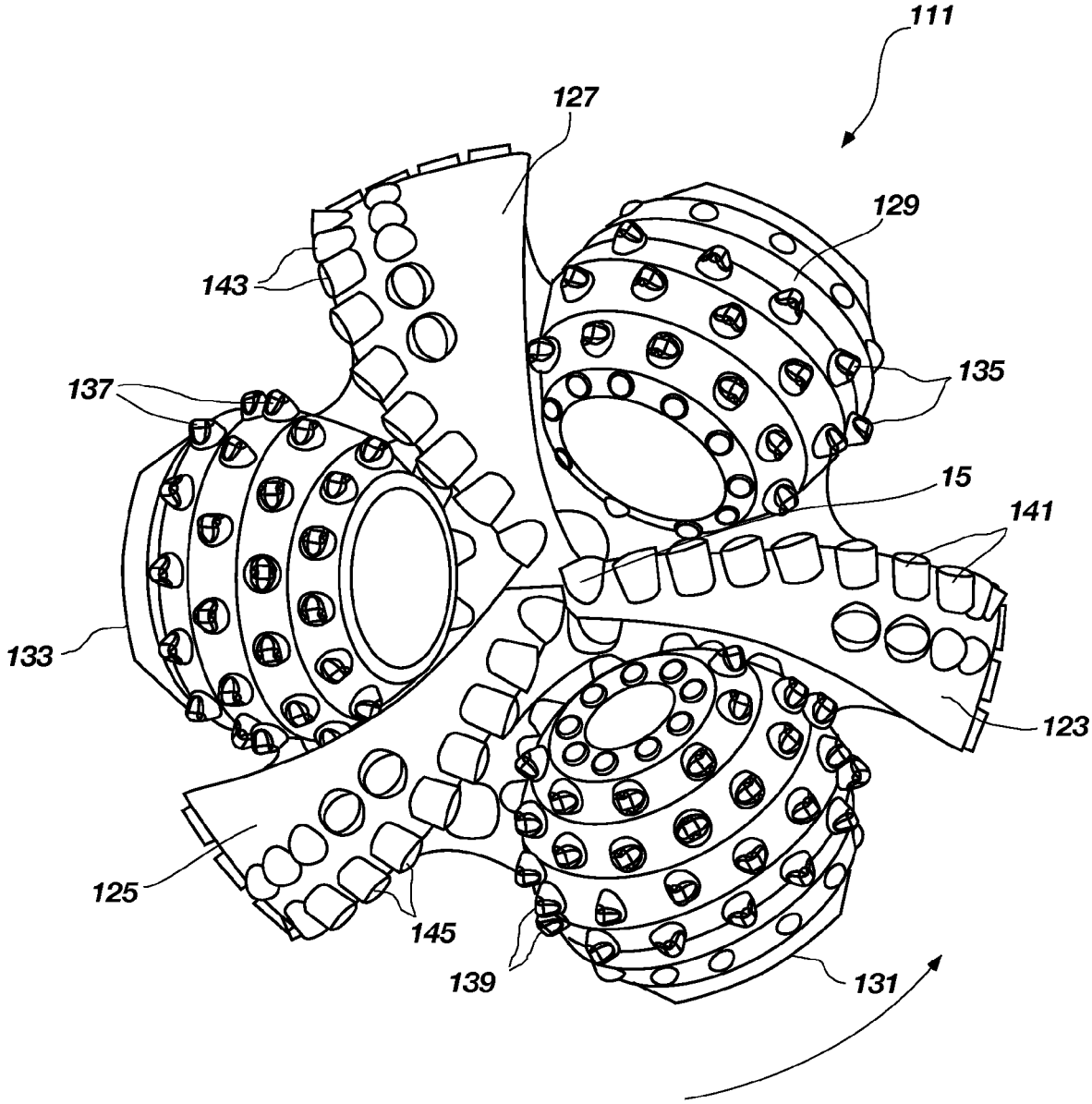
FIG. 4 is a bottom plan form view of another embodiment of a hybrid earth-boring bit of the present invention.

FIGS. 2, 3, and 4 illustrate embodiments of hybrid earth-boring bits 11 according to the present invention. Hybrid bit 11 comprises a bit body 13 that is threaded or otherwise configured at its upper extent for connection into a drill string. Bit body 13 may be constructed of steel, or of a hard-metal (e.g., tungsten carbide) matrix material with steel inserts. Bit body 13 has an axial center or centerline 15 that coincides with the axis of rotation of hybrid bit 11 in most instances. The illustrated hybrid bit 11 is a 12¼ inch bit. The hybrid bit 11 shown in FIG. 3 is used to exemplify the techniques of adjusting the aggressiveness of a hybrid bit according to the present invention, i.e., "cutter-leading," "blade-leading," and "cutter-blade opposite," as described herein. One of the embodiments of the hybrid bits of the present inventions illustrated in FIG. 3, is likely not a desirable production hybrid bit design when the hybrid bit is an all blade-leading design because aggressiveness of the hybrid bit is too great for certain types of formations, but not all types of formations. That is, if the hybrid bit is a hybrid bit having an all blade-leading design, it acts more as a fixed blade cutter bit. As illustrated in FIG. 1, aggressiveness of such hybrid bit is high which might adversely affect its durability and dynamic stability.

Illustrated in FIG. 2 and FIG. 3, at least one bit leg (two of three are shown in FIG. 2) 17, 19, 21 depends axially downwardly from the bit body 13. In the illustrated embodiment, a lubricant compensator is associated with each bit leg to compensate for pressure variations in the lubricant provided for the bearing. In between each bit leg 17, 19, 21, at least one fixed blade cutter 23, 25, 27 depends axially downwardly from bit body 13.

A rolling cutter 29, 31, 33 is mounted for rotation (typically on a journal bearing, but rolling-element or other bearings may be used as well) on each bit leg 17, 19, 21. Each rolling-cutter 29, 31, 33 has a plurality of cutting elements 35, 37, 39 arranged in generally circumferential rows thereon. In the illustrated embodiment, cutting elements 35, 37, 39 are tungsten carbide inserts, each insert having an interference fit into bores or apertures formed in each rolling cutter 29, 31, 33. Alternatively, cutting elements 35, 37, 39 can be integrally formed with the cutter and hardfaced, as in the case of steel- or milled-tooth cutters. Materials other than tungsten carbide, such as polycrystalline diamond or other super-hard or super-abrasive materials, can also be used for rolling-cutter cutting elements 35, 37, 39 on rolling-cutters 29, 31, 33.

A plurality of cutting elements 41, 43, 45 are arranged in a row on the leading edge of each fixed blade cutter 23, 25, 27. Each cutting element 41, 43, 45 is a circular disc of polycrystalline diamond mounted to a stud of tungsten carbide or other hard metal, which is in turn soldered, brazed or otherwise secured to the leading edge of each fixed blade cutter. Thermally stable polycrystalline diamond (TSP) or other conventional fixed-blade cutting element materials may also be used. Each row of cutting elements 41, 43, 45 on each of the fixed blade cutters 23, 25, 27 extends from the central portion of bit body 13 to the radially outermost or gage portion or surface of bit body 13. On at least one of the rows on one of the fixed blade cutters 23, 25, 27, a cutting element 41 on a fixed-blade cutter 23 is located at or near the central axis or centerline 15 of bit body 13 ("at or near" meaning some part of the fixed cutter is at or within about 0.040 inch of the centerline 15). In the illustrated embodiment, the radially innermost cutting element 41 in the row on fixed blade cutter 23 has its circumference tangent to the axial center or centerline 15 of the bit body 13 and hybrid bit 1.

A plurality of flat-topped, wear-resistant inserts 51 formed of tungsten carbide or similar hard metal with a polycrystalline diamond cutter attached thereto are provided on the radially outermost or gage surface of each fixed blade cutter 23, 25, 27. These serve to protect this portion of the bit from abrasive wear encountered at the sidewall of the borehole. Also, a row or any desired number of rows of back-up cutters 53 is provided on each fixed blade cutter 23, 25, 27 between the leading and trailing edges thereof. Back-up cutters 53 may be aligned with the main or primary cutting elements 41, 43, 45 on their respective fixed blade cutters 23, 25, 27 so that they cut in the same swath or kerf or groove as the main or primary cutting elements on a fixed blade cutter. Alternatively, they may be radially spaced apart from the main fixed-blade cutting elements so that they cut in the same swath or kerf or groove or between the same swaths or kerfs or grooves formed by the main or primary cutting elements on their respective fixed blade cutters. Additionally, back-up cutters 53 provide additional points of contact or engagement between the bit 11 and the formation being drilled, thus enhancing the stability of hybrid bit 11.

In the embodiments of the inventions illustrated in FIG. 3, rolling-cutters 29, 31, 33 can be truncated in length and are angularly spaced approximately 120 degrees apart from each other (measured between their axes of rotation). The axis of rotation of each rolling-cutter 29, 31, 33 intersecting the axial center 15 of bit body 13 or hybrid bit 11, although each or all of the rolling-cutters 29, 31, 33 may be angularly skewed by any desired amount and (or) laterally offset so that their individual axes do not intersect the axial center of bit body 13 or hybrid bit 11. As illustrated, a first rolling-cutter 29 is spaced apart 58 degrees from a first fixed blade 23 (measured between the axis of rotation of rolling cutter 29 and the centerline of fixed blade 23 in a clockwise manner in FIG. 3) forming a pair of cutters. A second rolling-cutter 31 is spaced 63 degrees from a second fixed blade 25 (measured similarly) forming a pair of cutters; and a third rolling-cutter 33 is spaced 53 degrees apart from a third fixed blade 27 (again measured the same way) forming a pair of cutters.

Figure 3A:
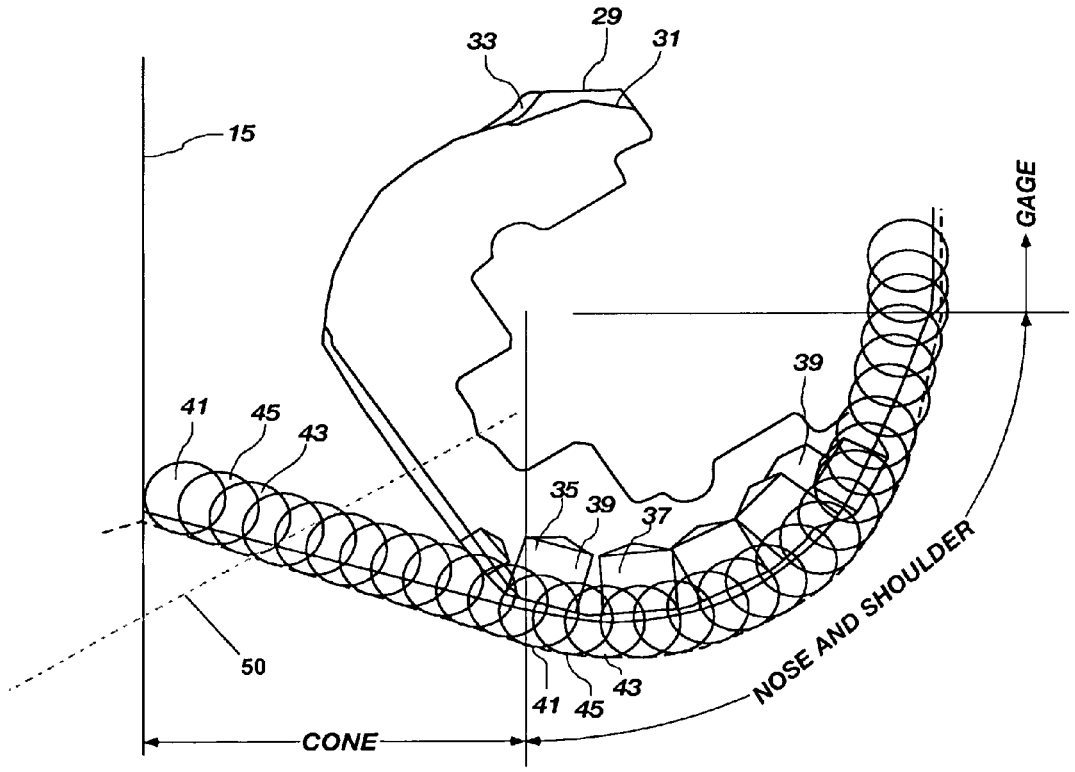
FIG. 3A is a profile view of cutting elements of a three fixed blade cutters and cutting elements of three rolling-cutters of an embodiment of a hybrid bit of the present inventions of FIGS. 1 through 3.

In FIG. 3A, a cutting profile for the fixed cutting elements 41, 45, 43 on fixed blade cutters 23, 25, 27 and cutting elements 35, 37, 39 on rolling-cutters 29, 33, 31 are generally illustrated. As illustrated, an inner most cutting element 41 on fixed blade cutter 23 is tangent to the axial center 15 of the bit body 13 or hybrid bit 11. The innermost cutting element 43 on fixed blade cutter 27 is illustrated. Also, innermost cutting element 45 on fixed blade cutter 25 is also illustrated. A cutting element 35 on rolling-cutter 29 is illustrated having the same cutting depth or exposure and cutting element 41 on fixed blade cutter 23 each being located at the same centerline and cutting the same swath or kerf or groove. Some cutting elements 41 on fixed blade cutter 23 are located in the cone of the hybrid bit 11, while other cutting elements 41 are located in the nose and shoulder portion of the hybrid bit 11 having cutting elements 35 of rolling cutter 29 cutting the same swath or kerf or groove generally in the nose and shoulder of the hybrid bit 11 out to the gage thereof. Cutting elements 35, 37, 39 on rolling-cutters 29, 33, 31 do not extend into the cone of the hybrid bit 11 but are generally located in the nose and shoulder of the hybrid bit 111 out to the gage of the hybrid bit. Further illustrated in FIG. 3A are the cutting elements 37, 39 on rolling-cutters 31 and 33 and their relation to the cutting elements 43 and 45 on fixed blade cutters 27, 25 cutting the same swath or kerf or groove either being centered thereon or offset in the same swath or kerf or groove during a revolution of the hybrid drill bit 11. While each cutting element 41, 43, 45 and cutting element 35, 37, 39 has been illustrated having the same exposure of depth of cut so that each cutting element cuts the same amount of formation, the depth of cut may be varied in the same swath or kerf or groove, if desired.

Figure 3B:
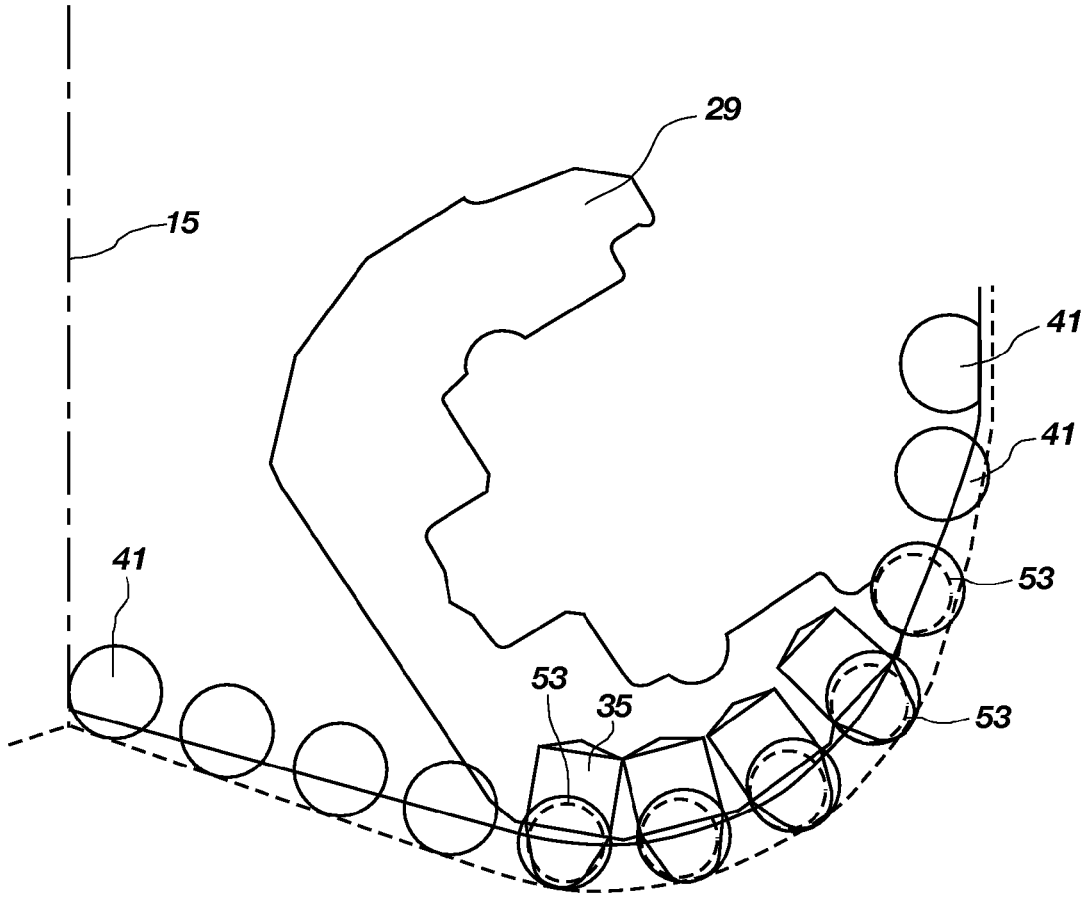
FIG. 3B is a profile view of cutting elements of a first fixed blade cutter and cutting elements of a first rolling-cutter of an embodiment of a hybrid bit of the present invention.

Illustrated in FIG. 3B is a cutting profile for the fixed cutting elements 41 on fixed blade cutter 23 and cutting elements 35 on rolling-cutter 29 in relation to the each other, the fixed blade cutter 23 and the rolling-cutter 29 forming a pair of cutters on hybrid bit 11. As illustrated, some of the cutting elements 41 on fixed blade cutter 23 and cutting element 35 on rolling-cutter 29 both have the same center and cut in the same swath or kerf or groove while other cutting elements 41' on fixed blade cutter 23 and cutting element 35' on rolling cutter 29 do not have the same center but still cut in the same swath or kerf or groove. As illustrated, all the cutting elements 41 and 41' on fixed blade cutter 23 and cutting elements 35 and 35' on rolling cutter 29 have the same exposure to cut the same depth of formation for an equal cut of the formation during a revolution of the hybrid drill bit 11, although this may be varied as desired. Further illustrated in FIG. 3B in broken lines, backup cutting elements 53 on fixed blade 23 located behind cutting elements 41 may have the same exposure of cut as cutting elements 41 or less exposure of cut as cutting elements 41 and have the same diameter or a smaller diameter than a cutting element 41. Additionally, backup cutting elements 53 while cutting in the same swath or kerf or groove 41' as a cutting element 41 may be located off the center of a cutting element 41 located in front of a backup cutting element 53 associated therewith. In this manner, cutting elements 41 and backup cutting elements 53 on fixed blade 23 and cutting elements 35 on rolling cutter 29 will all cut in the same swath or kerf or groove while being either centered on each other of slightly off-centered from each other having the same exposure of cut or, in the alternative, a lesser exposure of cut.

Figure 3C:
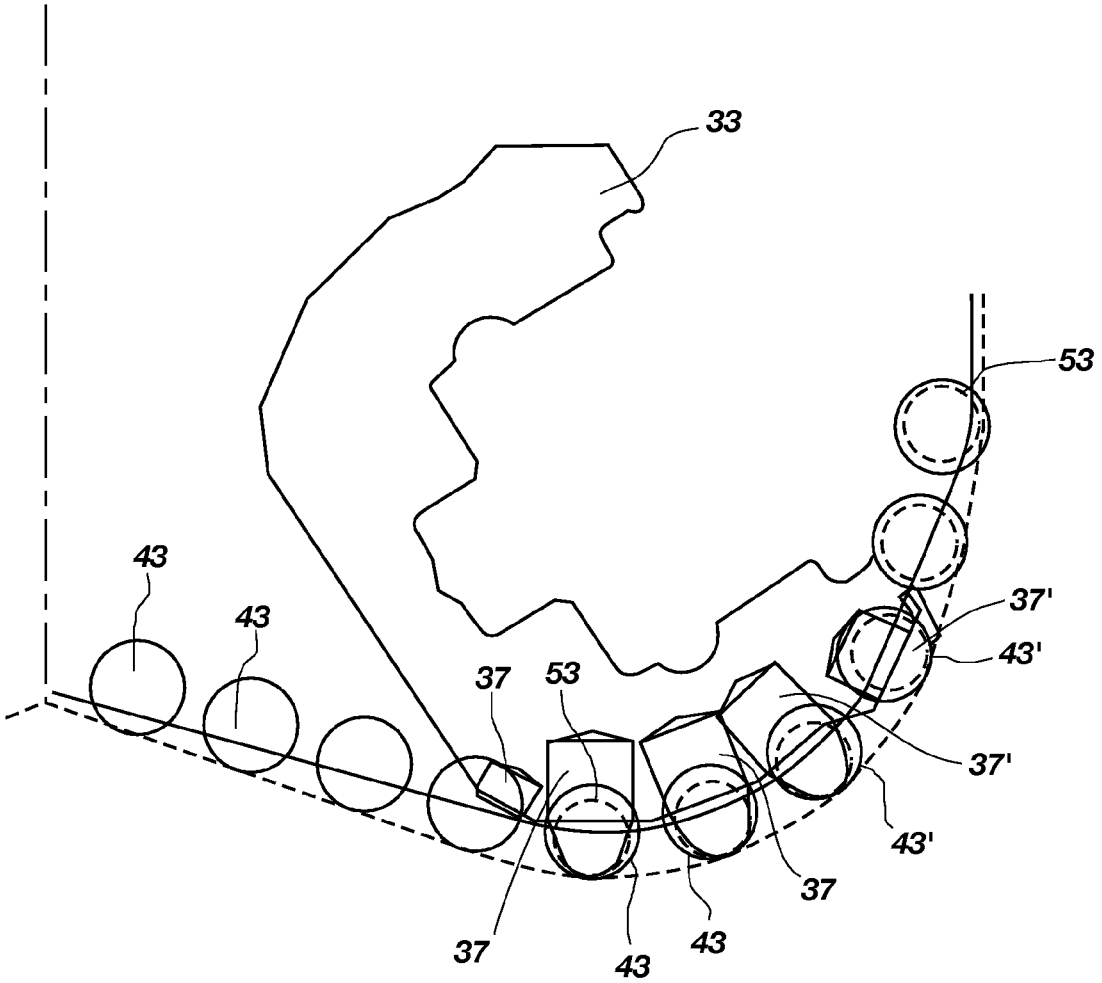
FIG. 3C is a profile view of cutting elements of a second fixed blade cutter and cutting elements of a second rolling-cutter of an embodiment of a hybrid bit of the present invention.

Illustrated in FIG. 3C is a cutting profile for the fixed cutting elements 43 on fixed blade cutter 27 in relation to the cutting elements 37 on rolling-cutter 33, the fixed blade cutter 27 and the rolling-cutter 33 forming a pair of cutters on hybrid bit 11. As illustrated, some of the cutting elements 43 on fixed blade cutter 27 and cutting element 37 on rolling-cutter 33 both have the same center and cutting in the same swath or kerf or groove while other cutting elements 43' on fixed blade cutter 23 and cutting element 37' on rolling cutter 33 do not have the same center but cut in the same swath or kerf or groove. As illustrated, all the cutting elements 43 and 43' on fixed blade cutter 27 and cutting elements 37 and 37' on rolling cutter 33 have the same exposure to cut the same depth of formation for an equal cut of the formation during a revolution of the hybrid drill bit 11, although this may be varied as desired. Further illustrated in FIG. 3C in broken lines, backup cutting elements 53 on fixed blade 27 located behind cutting elements 43 may have the same exposure of cut as cutting elements 43 or less exposure of cut as cutting elements 43 and have the same diameter or a smaller diameter than a cutting element 43. Additionally, backup cutting elements 53 while cutting in the same swath or kerf or groove as a cutting element 43 may be located off the center of a cutting element 43 associated therewith. In this manner, cutting elements 43 and backup cutting elements 53 on fixed blade cutter 27 and cutting elements 37 on rolling cutter 33 will all cut in the same swath or kerf or groove while being either centered on each other of slightly off-centered from each other having the same exposure of cut or, in the alternative, a lesser exposure of cut.

Figure 3D:
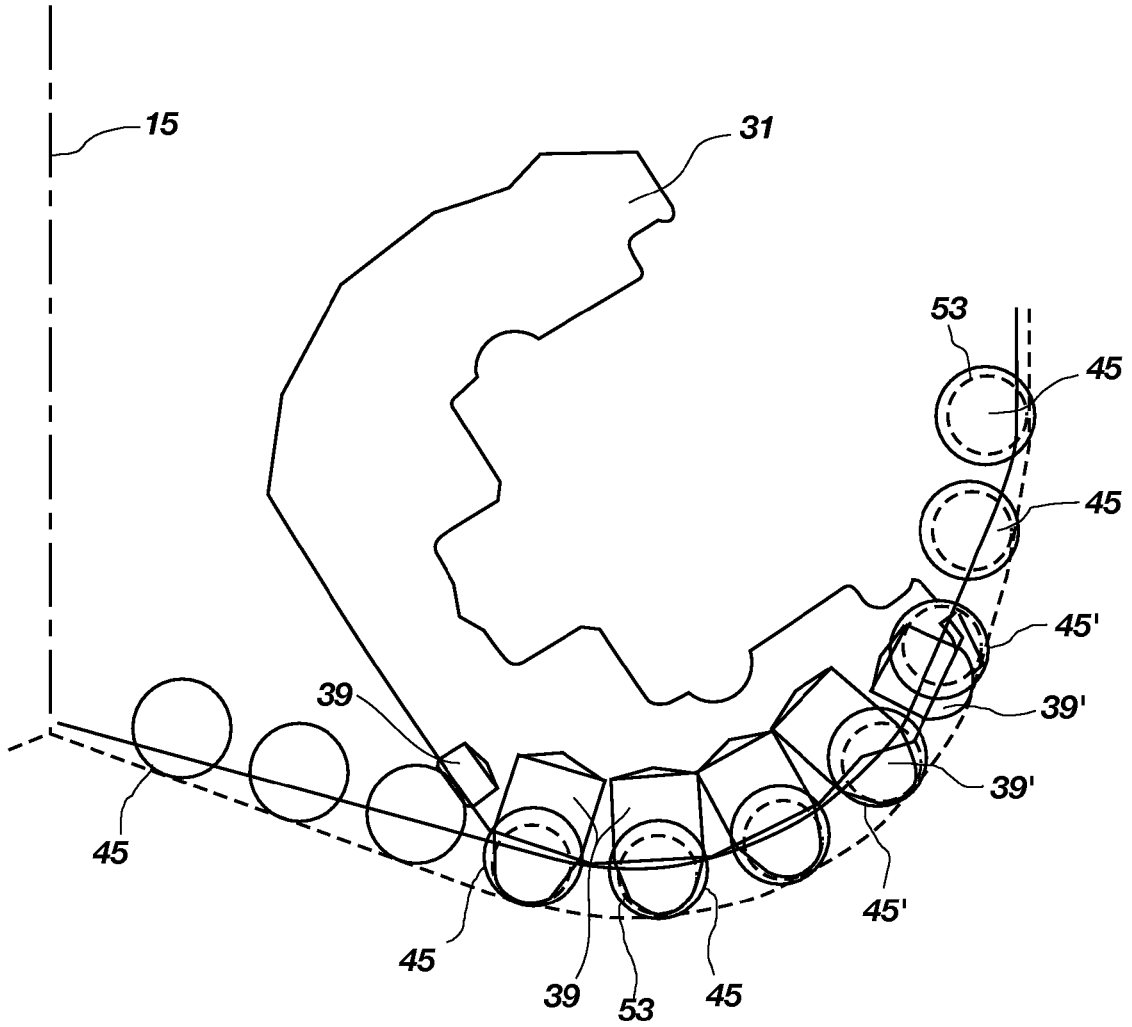
FIG. 3D is a view of cutting elements of a third fixed blade cutter and cutting elements of a third rolling-cutter of an embodiment of a hybrid bit of the present invention.

Illustrated in FIG. 3D is a cutting profile for the fixed cutting elements 45 on fixed blade cutter 25 in relation to cutting elements 39 on rolling-cutter 31 forming a pair of cutters on hybrid bit 11. As illustrated, some of the cutting elements 45 on fixed blade cutter 25 and cutting element 39 on rolling-cutter 31 both have the same center and cutting in the same swath or kerf or groove while other cutting elements 45' on fixed blade cutter 25 and cutting element 39' on rolling cutter 31 do not have the same center but cut in the same swath or kerf or groove. As illustrated, all the cutting elements 45 and 45' on fixed blade cutter 25 and cutting elements 39 and 39' on rolling cutter 33 have the same exposure to cut the same depth of formation for an equal cut of the formation, although this may be varied as desired. As illustrated, all the cutting elements 45 and 45' on fixed blade cutter 25 and cutting elements 39 and 39' on rolling-cutter 31 have the same exposure to cut the same depth of formation for an equal cut of the formation during a revolution of the hybrid drill bit 11. Further illustrated in FIG. 3D in broken lines, backup cutting elements 53 on fixed blade 25 located behind cutting elements 45 may have the same exposure of cut as cutting elements 45 or less exposure of cut as cutting elements 45 and have the same diameter or a smaller diameter than a cutting element 45. Additionally, backup cutting elements 53 while cutting in the same swath or kerf or groove as a cutting element 45 may be located off the center of a cutting element 45 associated therewith. In this manner, cutting elements 45 and backup cutting elements 53 on fixed blade cutter 25 and cutting elements 39 on rolling cutter 31 will all cut in the same swath or kerf or groove while being either centered on each other of slightly off-centered from each other having the same exposure of cut or, in the alternative, a lesser exposure of cut.

When considering a pair of cutters of the hybrid bit 11 including a rolling cutter and a fixed blade cutter, each having cutting elements thereon, having the same exposure of cut, and located at the same radial location from the axial center of the hybrid bit 11 cutting the same swath or kerf or groove, adjusting the angular spacing between rolling cutters 29, 31, 33, and fixed blade cutters 23, 25, 27 is one way in which to adjust the cutting aggressiveness or aggressiveness of a hybrid bit 11 according to the present invention. When considering a pair of cutters having cutting elements thereon having the same exposure of cut and located at the same radial location from the axial center of the hybrid bit 11 cutting the same swath or kerf or groove on the hybrid bit 11, the closer a rolling cutter 29 is to a fixed blade cutter 23 of the pair of cutters of the hybrid bit 11, the rolling-cutter 29 is the primary cutter of the pair with the fixed blade cutter 23 cutting less of the pair. Spacing a rolling cutter 29 closer to a fixed blade cutter 23 of a pair of cutters on the hybrid bit 11 causes the rolling cutter 29 to have a more dominate cutting action of the pair of cutters thereby causing the hybrid bit 11 to have less cutting aggressiveness or aggressiveness. Spacing a rolling-cutter 29 farther away from a fixed blade cutter 23 of a pair of cutters on the hybrid bit 11 allows or causes the cutting elements of the fixed blade cutter 23 to dominate the cutting action of the pair of cutters thereby increasing the cutting aggressiveness or aggressiveness of the hybrid bit 11.

Another way of altering the cutting aggressiveness of a hybrid bit 11 is by having a rolling cutter to lead a trailing fixed blade cutter of a pair of cutters (including one of each type of cutter) or to have a fixed blade cutter lead a trailing rolling cutter of a pair of cutters (including one of each type of cutter). As illustrated in drawing FIG. 1, when a fixed blade cutter leads a rolling cutter of a pair of cutters of a hybrid bit 11 (see line HBLC), the hybrid bit 11 has more cutting aggressiveness cutting more like a fixed blade cutter polycrystalline diamond (PDC) bit. As illustrated in FIG. 1, when a rolling cutter leads a fixed blade cutter of a pair of cutters of a hybrid bit 11 (see line HCLB), the aggressiveness decreases with the hybrid bit having aggressiveness more like a rolling-cutter (roller cone) bit.

Figure 3E:
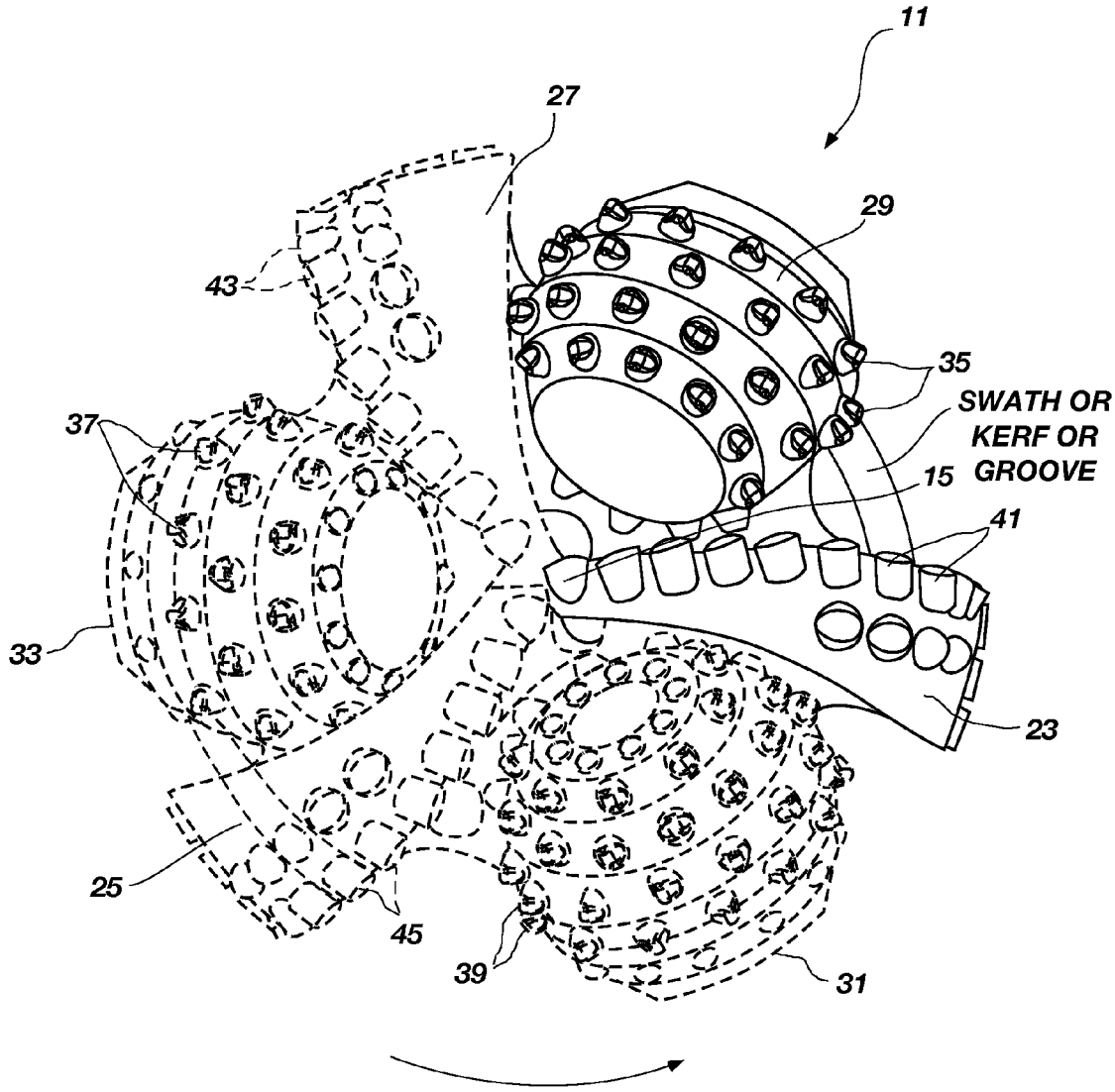
FIG. 3E is a view of FIG. 3 showing a pair of a rolling-cutter and a fixed blade cutter of a hybrid bit of FIG. 3 of the present invention.
Figure 3F:
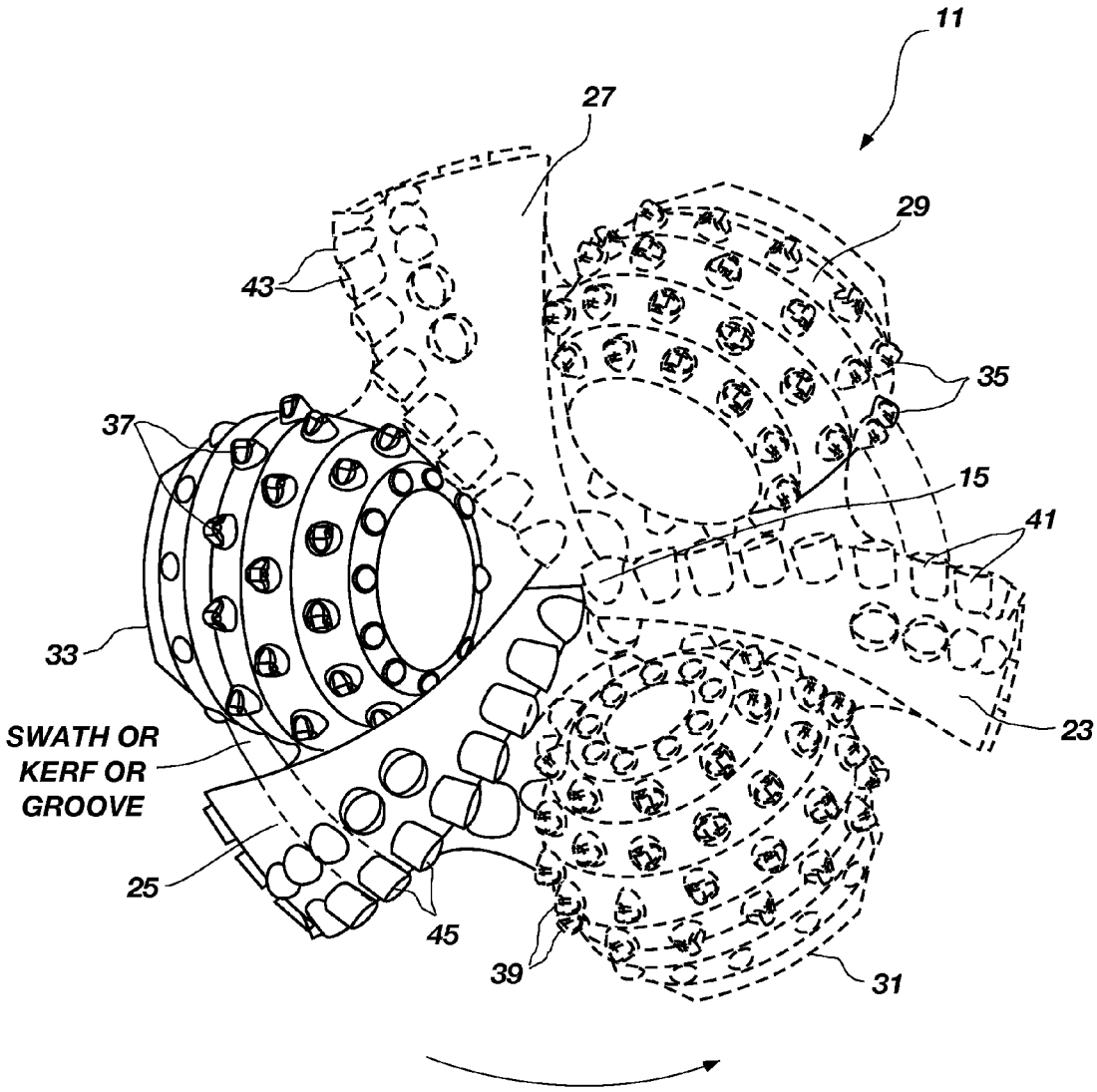
FIG. 3F is a view of FIG. 3 showing another fixed blade cutter and another rolling-cutter of a hybrid bit of FIG. 3 of the present invention.

In the illustrated hybrid bit 11 of FIG. 3E, for the purposes of illustrating different embodiments of the present invention, one rolling cutter 29 "leads" its trailing fixed blade cutter 23 as a pair of cutters. As illustrated in FIG. 3F as another embodiment of the present invention, one fixed blade cutter 25 "leads" its trailing rolling cutter 33 as a pair of cutters. By "leads" it is meant that the cutting elements on the adjacent, trailing structure (whether fixed blade cutter or rolling cutter) are arranged to fall in the same swath or kerf or groove as that made by the cutting elements on the leading structure (whether a fixed blade cutter or rolling cutter), as indicated by phantom lines in FIG. 3E or FIG. 3F. Thus, the cutting elements 41 on fixed blade cutter 23 fall in the same swath or kerf or groove (see FIG. 3A, FIG. 3B) as the cutting elements 35 on rolling cutter 29. Similarly, the cutting elements 37 on rolling-cutter 33 fall in the same swath or kerf or groove (see FIG. 3A, FIG. 3C) as cutting elements 45 on fixed blade cutter 25. When a rolling cutter leads a trailing fixed blade cutter, cutting aggressiveness or aggressiveness of the hybrid bit 11 is decreased. Conversely, when a fixed blade cutter leads a trailing rolling-cutter, cutting aggressiveness or aggressiveness of the hybrid bit 11 is increased. Such is illustrated in FIG. 1 in the broken lines labeled HCLB and HBLC therein.

Also, in the embodiments of FIG. 3, rolling cutter 31 has its cutting elements 39 arranged to lead the cutting elements 43 on the opposing (if not directly opposite, i.e., 180 degrees) fixed blade cutter 27. Thus, being angularly spaced-apart approximately 180 degrees on the hybrid bit 11, fixed blade cutter 27 and rolling-cutter 31 bear load approximately equally on the hybrid bit 11. In most cases, where there are an equal number of fixed blade cutters and rolling-cutters, each fixed blade cutter should be "paired" with a rolling-cutter such that the cutting elements on the paired fixed blade cutter and rolling-cutter fall in the same swath or kerf or groove when drilling a formation. All rolling cutters can lead all fixed blade cutters, making a less aggressive bit (see solid line HCLB in FIG. 1); or all fixed blade cutters can lead all rolling-cutters, making a more aggressive bit (see broken line HBLC in FIG. 1), or the all cutting elements of a rolling-cutter can fall in the same swath or kerf or groove as the cutting elements on an opposing fixed blade (see broken line HCOB in FIG. 1), or any combination thereof on a hybrid bit of the present invention.

FIG. 4 illustrates an embodiment of the earth-boring hybrid bit 111 according to the present invention that is similar to the embodiments of FIG. 3 in all respects, except that cutting elements 135, 137, 139 on each of the rolling cutters—129, 133, 131 respectively are arranged to cut in the same swath or kerf or groove as the cutting elements 145, 141, 143 on the opposite or opposing fixed blade cutters 125, 122, 127 respectively. Thus, the cutting elements 135 on rolling cutter 129 fall in the same swath or kerf or groove as the cutting elements 145 on the opposing fixed blade cutter 125. The same is true for the cutting elements 139 on rolling cutter 131 and the cutting elements 143 on the opposing fixed blade cutter 127; and the cutting elements 137 on rolling cutter 133 and the cutting elements 141 on opposing fixed blade cutter 123. This can be called a "cutter-opposite" arrangement of cutting elements. In such an arrangement, rather than the cutting elements on a fixed blade cutter or rolling-cutter "leading" the cutting elements on a trailing rolling-cutter or fixed blade cutter, the cutting elements on a fixed blade cutter or rolling-cutter "oppose" those on the opposing or opposite rolling-cutter or fixed blade cutter.

The hybrid bit 111 of FIG. 4, having the "cutter-opposite" configuration of pairs of cutters, appears to be extremely stable in comparison to all configurations of "cutter-leading" pairs of cutters or all "blade-leading" pairs of cutters. Additionally, based on preliminary testing, the hybrid bit 111 of FIG. 4 out drills a conventional rolling-cutter bit and a conventional fixed blade cutter bit having polycrystalline diamond cutting elements (PDC bit), as well as other hybrid bit configurations ("cutter-leading") in hard sandstone. For example, a conventional 12¼ inch rolling-cutter bit drills the hard sandstone at 11 feet/hour, a conventional fixed blade cutter bit having polycrystalline diamond cutting elements (PDC bit) at 13 feet/hour, the hybrid bit with "cutter-leading" pair of cutters configuration at 14 feet/hour and the hybrid bit with "cutter-opposite" pair of cutters configuration at 21 feet/hour. Different types of hard sandstone is the material that are most difficult formations to drill using fixed blade cutter bits mainly due to high levels of scatter vibrations. In that particular application, the balanced loading resulting from the "cutter-opposite" pair of cutters configuration of a hybrid bit is believed to produce a significant difference over other types and configurations of bits. In softer formations (soft and medium-hard), it is believed that the more aggressive "blade-leading" pair of cutter hybrid bit configurations will result in the best penetration rate. In any event, according to the preferred embodiment of the present invention, the aggressiveness of a hybrid bit can be tailored or varied to the particular drilling and formation conditions encountered.

Still another way to adjust or vary the aggressiveness of the hybrid bit 11 is to arrange the cutting elements 35, 37, 39 on the rolling-cutters 29, 31, 33 so that they project deeper into the formation being drilled than the cutting elements 41, 43, 45 on the fixed blade cutters 23, 25, 27. The simplest way to do this is to adjust the projection of some or all of the cutting elements 35, 37, 39 on the rolling-cutters 29, 31, 33 from the surface of each rolling cutter 29, 31, 33 so that they project in the axial direction (parallel to the bit axis 15) further than some or all of the cutting elements 41, 43, 45 on fixed blades cutters 23, 25, 27. In theory, the extra axial projection of a cutting element of the cutting elements on the rolling cutters causes the cutting element to bear more load and protects an associated cutting element of the fixed blade cutter.

Figure 5:
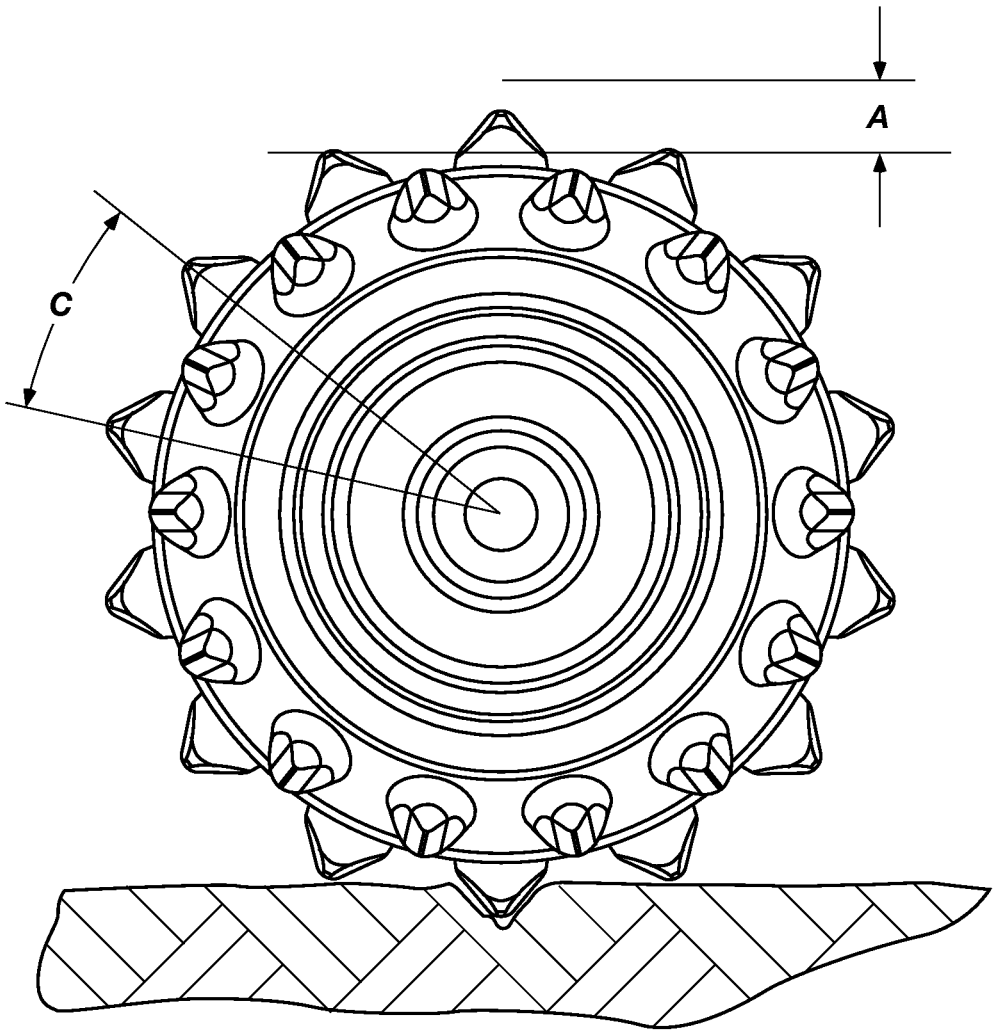
FIGS. 5 and 6 are partial schematic views of rolling-cutters and cutting elements of rolling-cutters interfacing with the formation being drilled.
Figure 6:
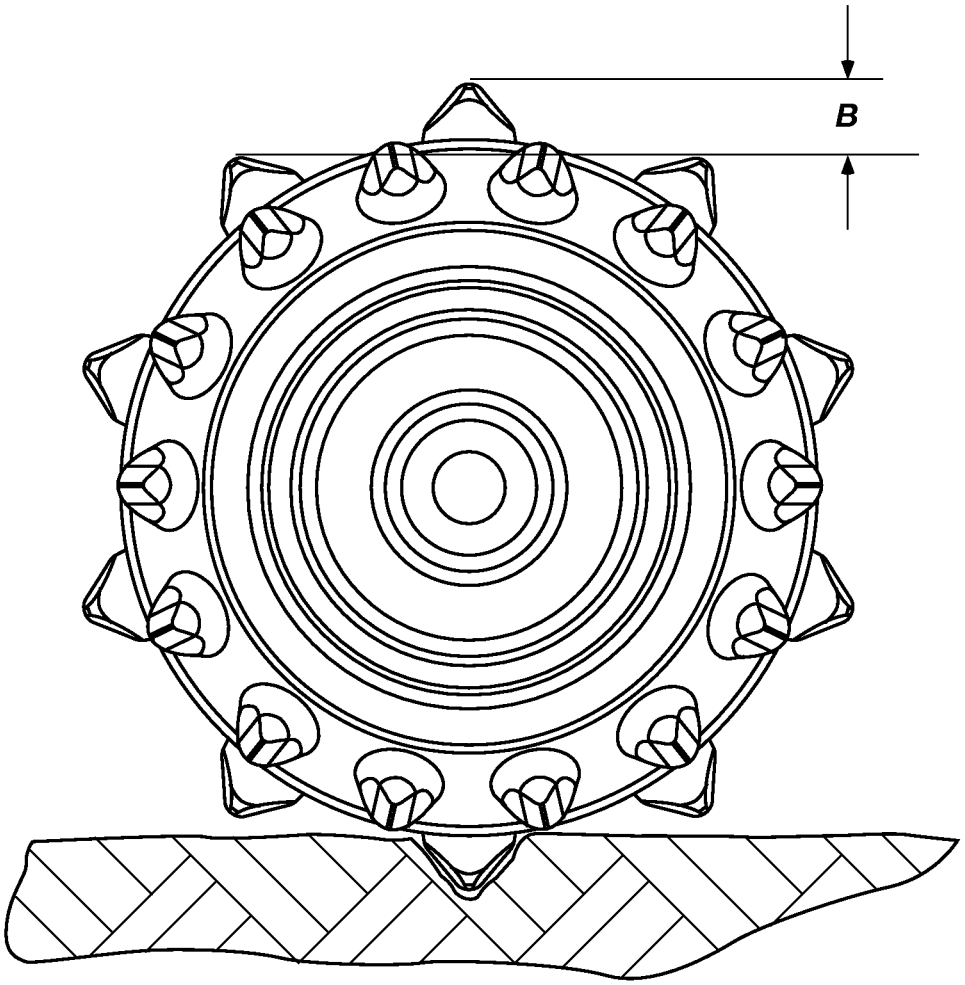

In practice, it is a combination of the projection of each cutting element of a rolling-cutter from the surface of its rolling cutter, combined with its angular spacing (pitch) from adjacent cutting elements that governs whether the cutting elements of a rolling-cutter actually bear more of the cutting load than an associated cutting element on a fixed blade cutter. This combination is referred to herein as "effective projection," and is illustrated in FIGS. 5 and 6. As shown in FIG. 5, the effective projection A of a given cutting element of a rolling-cutter, or that projection of the cutting element available to penetrate into earthen formation, is limited by the projection of each adjacent cutting element and the angular distance or pitch C between the adjacent cutting elements and the given cutting element. FIG. 6 illustrates "full" effective projection B in that the pitch is selected so that the adjacent cutting elements on either side of a given cutting element permit penetration of the cutting element to a depth equal to its full projection from the surface of a rolling-cutter.

From the exemplary embodiment described above, a method for designing a hybrid earth-boring bit of the present invention permits or allows the cutting aggressiveness of a hybrid bit to be adjusted or selected based on the relationship of at least a pair of cutters comprising a fixed blade cutter and a rolling-cutter, of a plurality of fixed blade cutters and rolling-cutters, wherein the relationship includes a fixed blade cutter leading a rolling-cutter in a pair of cutters, a rolling-cutter leading a fixed blade cutter in a pair of cutters, a rolling-cutter being located opposite a fixed blade cutter in a pair of cutters on the bit, and the angular relationship of a fixed blade cutter and a rolling-cutter of a pair of cutters regarding the amount of leading or trailing of the cutter from an associated cutter of the pair of cutters. The cutting aggressiveness of a hybrid bit of the present invention being achieved by defining a cutting aggressiveness of a hybrid drill bit and the various combinations of pair of a fixed blade cutter and a rolling-cutter, when compared to each other and to different types of drill bits, such as a rolling-cutter drill bit and a fixed blade cutter drill bit, either as the ratio of torque to weight-on-bit or as the ratio of penetration rate to weight-on-bit. The cutting aggressiveness for a hybrid bit of the present invention being adjusted by performing at least one of the following steps:

- adjusting the angular distance between each rolling-cutter and each fixed blade cutter of a pair of cutters of the bit;
- adjusting the effective projection of the cutting elements on a rolling cutter;
- arranging the cutting elements of a fixed blade and the cutting elements of a rolling-cutter so that at least one cutting element of a rolling-cutter and at least one cutting element of a fixed blade cut the same swath or kerf or groove during a drilling operation; and
- arranging a pair of at least one fixed blade cutter and a rolling-cutter so that the rolling cutter either leads the fixed blade cutter [(<180°) angular distance], the rolling cutter opposes the fixed blade cutter [(=180°) angular distance], or trails the fixed blade cutter [(>180°) angular distance].

As described above, decreasing the angular distance between a leading rolling-cutter and fixed blade cutter decreases aggressiveness of the pair of cutters, while increasing the distance therebetween increases aggressiveness of the pair of cutters. Increasing the effective projection on cutting elements of a rolling-cutter by taking into account the pitch between them increases the aggressiveness and the converse is true. Finally, designing the cutting elements on a fixed blade to lead the cutting elements on the trailing rolling-cutter increases aggressiveness, while having a rolling-cutter leading its trailing fixed blade cutter has the opposite effect. According to this method, aggressiveness is increased, generally, by causing the scraping action of the cutting elements and fixed blades and to dominate over the crushing action of the cutting elements and the rolling-cutters.

Increased aggressiveness is not always desirable because of the erratic torque responses that generally come along with it. The ability to tailor a hybrid bit to the particular application can be an invaluable tool to the bit designer.

The invention has been described with reference to preferred or illustrative embodiments thereof. It is thus not limited, but is susceptible to variation and modification without departing from the scope of the invention.

We claim:

1. A method of varying a cutting rate of a bit used during drilling a well, the bit having a bit body, at least one fixed blade cutter depending downwardly from the bit body, at least one frustoconical rolling cutter mounted for rotation on a bit leg depending downwardly from the bit body, a plurality of cutting elements arranged on a leading edge of the at least one fixed blade cutter and wherein the plurality of cutting elements are disposed in parallel with at least one row of back-up cutters arranged between the leading edge of the at least one fixed blade cutter and a trailing edge of the at least one fixed blade cutter, wherein at least one of the plurality of cutting elements on the leading edge of the fixed blade is located at or within about 0.040 inch of a central axis of rotation of the bit body, and a plurality of cutting elements arranged on the at least one frustoconical rolling cutter, the method comprising:

- defining an aggressiveness of the bit as a function of penetration rate of the bit during drilling to weight-on-bit during drilling; and
- adjusting the aggressiveness of the bit by one or more methods selected from the group consisting of:
- adjusting the angular distance between each frustoconical rolling cutter and each fixed blade cutter;
- adjusting the effective projection between at least two adjacent cutting elements on a frustoconical rolling cutter, wherein the frustoconical rolling cutter is truncated in length;
- arranging the cutting elements of the at least one fixed-blade cutter and the cutting elements of the at least one frustoconical rolling-cutter so that one of the rolling-cutter and the fixed blade cutter leads the other; and
- arranging the cutting elements of the at least one fixed-blade cutter and the cutting elements of the at least one frustoconical rolling-cutter on an opposing rolling cutter and fixed blade cutter so that the cutting elements of the at least one fixed-blade cutter and cutting elements of the at least one frustoconical rolling-cutter fall in the same kerf during drilling operations,
- wherein the cutting elements of the frustoconical rolling cutter are arranged to lead the cutting elements on the fixed blade cutter which is angularly spaced apart from the rolling cutter approximately 180 degrees;
- wherein the aggressiveness is further defined by the position of the at least one row of back-up cutters with respect to the leading edge of the at least one fixed blade cutter.

2. A method of varying a cutting rate of a bit used during drilling a well, the bit having a bit body, at least two fixed blade cutters depending downwardly from the bit body, at least one frustoconical rolling cutter mounted for rotation on a bit leg depending downwardly from the bit body, a plurality of cutting elements arranged on a leading edge of each of the at least two fixed blade cutters and wherein the plurality of cutting elements are disposed in parallel with at least one row of back-up cutters arranged between a leading edge of the at least two fixed blade cutters and a trailing edge of the at least two fixed blade cutters, wherein at least one of the plurality of cutting elements on the leading edge of the fixed blade is located at or within about 0.040 inch of a central axis of rotation of the bit body, and a plurality of cutting elements arranged on the at least one frustoconical rolling cutter, the method comprising:

defining an aggressiveness of the bit as a function of penetration rate of the bit during drilling to weight-on-bit during drilling; and adjusting the aggressiveness of the bit by one or more methods selected from the group consisting of:

adjusting the angular distance between each frustoconical rolling cutter, wherein each frustoconical rolling cutter is truncated in length, and each fixed blade cutter of the at least two fixed blade cutters; adjusting the effective projection between at least two adjacent cutting elements on a frustoconical rolling cutter;

arranging the cutting elements of the at least one fixed-blade cutter and the cutting elements of the at least one frustoconical rolling-cutter so that one of the rolling-cutter and the fixed blade cutter leads the other; and arranging the cutting elements one of the at least two fixed-blade cutters and the cutting elements of the at least one frustoconical rolling-cutter on an opposing rolling cutter and a fixed blade cutter of the at least two fixed blade cutters so that the cutting elements of the at least one fixed-blade cutter and cutting elements of the at least one frustoconical rolling-cutter fall in the same kerf during drilling operations, wherein the cutting elements of the frustoconical rolling cutter are arranged to lead the cutting elements on the fixed blade cutter which is angularly spaced apart from the rolling cutter approximately 180 degrees;

wherein the aggressiveness is further defined by the position of the at least one row of back-up cutters with respect to the leading edge of the at least two fixed blade cutters.

3. A method of varying a cutting rate of a bit used during drilling a well, the bit having a bit body, at least two fixed blade cutters depending downwardly from the bit body, at least two frustoconical rolling cutters mounted for rotation on a bit leg depending downwardly from the bit body, a plurality of cutting elements arranged on a leading edge of each of the at least two fixed blade cutters and wherein the plurality of cutting elements are disposed in parallel with at least one row of back-up cutters arranged between a leading edge of the at least two fixed blade cutters and a trailing edge of the at least two fixed blade cutters, wherein at least one of the plurality of cutting elements on the leading edge of the fixed blade is located at or within about 0.040 inch of a central axis of rotation of the bit body, and a plurality of cutting elements arranged on the each of the at least two frustoconical rolling cutters, the method comprising:

defining an aggressiveness of the bit as a function of penetration rate of the bit during drilling to weight-on-bit during drilling; and adjusting the aggressiveness of the bit by one or more methods selected from the group consisting of:

adjusting the angular distance between each frustoconical rolling cutter and each fixed blade cutter, wherein each frustoconical rolling cutter is truncated in length;

adjusting the effective projection between at least two adjacent cutting elements on a frustoconical rolling cutter;

arranging the cutting elements of the at least one fixed-blade cutter and the cutting elements of the at least one frustoconical rolling-cutter so that one of the rolling-cutter and the fixed blade cutter leads the other; and arranging the cutting elements of the at least two fixed-blade cutters and the cutting elements of the at least two frustoconical rolling-cutters on an opposing rolling cutter and fixed blade cutter so that the cutting elements of the at least one fixed-blade cutter and cutting elements of the at least one frustoconical rolling-cutter fall in the same kerf during drilling operations, wherein the cutting elements of the frustoconical rolling cutter are arranged to lead the cutting elements on the fixed blade cutter which is angularly spaced apart from the rolling cutter approximately 180 degrees;

wherein the aggressiveness is further defined by the position of the at least one row of back-up cutters with respect to the leading edge of the at least two fixed blade cutters.

4. A method of varying a cutting rate of a bit used during drilling a well, the bit having a bit body, three fixed blade cutters depending downwardly from the bit body, three frustoconical rolling cutters mounted for rotation on a bit leg depending downwardly from the bit body, a plurality of cutting elements arranged on a leading edge of each fixed blade cutter and wherein the plurality of cutting elements are disposed in parallel with at least one row of back-up cutters arranged between a leading edge of the three fixed blade cutters and a trailing edge of the three fixed blade cutters, wherein one of the plurality of cutting elements on the leading edge of the fixed blade is located at or within about 0.040 inch of a central axis of rotation of the bit body, and a plurality of cutting elements arranged on each frustoconical rolling cutter, the method comprising:

defining an aggressiveness of the bit as a function of penetration rate of the bit during drilling to weight-on-bit during drilling; and adjusting the aggressiveness of the bit by one or more methods selected from the group consisting of:

adjusting the angular distance between each frustoconical rolling cutter and each fixed blade cutter, wherein each frustoconical rolling cutter is truncated in length;

adjusting the effective projection between at least two adjacent cutting elements on a frustoconical rolling cutter;

arranging the cutting elements of the at least one fixed-blade cutter and the cutting elements of the at least one frustoconical rolling-cutter so that one of the rolling-cutter and the fixed blade cutter leads the other; and arranging the cutting elements of the three fixed-blade cutters and the cutting elements of the three frustoconical rolling-cutters on an opposing rolling cutter and fixed blade cutter so that the cutting elements of the three fixed-blade cutters and cutting elements of the three rolling-cutters fall in the same kerf during drilling operations, wherein the cutting elements of the frustoconical rolling cutter are arranged to lead the cutting elements on the fixed blade cutter which is angularly spaced apart from the rolling cutter approximately 180 degrees;

wherein the aggressiveness is further defined by the position of the at least one row of back-up cutters with respect to the leading edge of the three fixed blade cutters.

5. A method of varying cutting aggressiveness of a hybrid bit having at least one fixed blade cutter and at least one rolling cutter, the method comprising:

forming a bit having a bit body having a centerline as the axis of rotation of the bit body, having at least one fixed blade cutter attached to the bit body about the centerline, wherein at least one of the fixed blade cutters has one of a plurality of cutting elements arranged on a leading edge of the fixed blade that is located at or within about 0.040 inch of the axis of rotation of the bit body and wherein the plurality of cutting elements are disposed in parallel with at least one row of back-up cutters arranged between a leading edge of the at least one fixed blade cutter and a trailing edge of the at least one fixed blade cutter, and having at least one frustoconical rolling cutter truncated in length and mounted for rotation on a bit leg secured to the bit body about the centerline, the angle between the fixed blade cutter and the at least one frustoconical rolling cutter being any angle other than ninety degrees;

attaching at least one cutting element arranged in a first position a first radial distance from the centerline of the bit body on a leading edge of the fixed blade cutter; and attaching a first cutting element on the frustoconical rolling cutter arranged in a first position a second radial distance from the centerline of the bit body on the frustoconical rolling cutter mounted on a bit leg secured to the bit body to follow the cutting element arranged in the first position on the leading edge of the fixed blade cutter, wherein the cutting elements of the frustoconical rolling cutter are arranged to lead the cutting elements on the fixed blade cutter which is angularly spaced apart from the rolling cutter approximately 180 degrees;

wherein the aggressiveness is further defined by the position of the at least one row of back-up cutters with respect to the leading edge of the at least one fixed blade cutter.

6. The method of claim 5, further comprising:

attaching a second cutting element on the at least one rolling cutter at a second position at a second radial distance from the centerline of the bit body on the at least one rolling cutter mounted on a bit leg secured to the bit body to follow a cutting element arranged in a first position on the leading edge of the fixed blade cutter.

7. The method of claim 6, further comprising:

spacing one of the first cutting element and the second cutting element attached to the at least one rolling cutter so that only one of the first cutting element and the second cutting element engages independently during cutting a formation using the hybrid bit.

8. The method of claim 6, further comprising:

spacing each of the first cutting element and the second cutting element attached to the at least one rolling cutter so that each of the first cutting element and the second cutting element has a portion thereof engaging simultaneously during cutting a formation using the hybrid bit.

9. The method of claim 5, wherein the first radial distance and the second radial distance are selected from the group consisting of the same distance from the centerline of the bit body, different distances from the centerline of the bit body, and approximately the same distance from the centerline of the bit body.

10. The method of claim 5, further comprising:

attaching at least one cutting element arranged in a second position a second radial distance from the centerline of the bit body on a leading edge of the fixed blade cutter;

attaching at least one cutting element on the rolling cutter arranged in a second position a second radial distance from the centerline of the bit body on the rolling cutter mounted on a bit leg secured to the bit body to follow a cutting element arranged in a second position on the leading edge of the fixed blade cutter.

11. The method of claim 10, further comprising:

attaching another cutting element on the rolling cutter arranged in a first position a first radial distance from the centerline of the bit body on the rolling cutter mounted on a bit leg secured to the bit body to follow the cutting element arranged in a first position on the leading edge of the fixed blade cutter; and attaching another cutting element on the rolling cutter arranged in a second position a second radial distance from the centerline of the bit body on the rolling cutter mounted on a bit leg secured to the bit body to follow the cutting element arranged in a second position on the leading edge of the fixed blade cutter.

12. A method of varying a cutting rate of a bit used during drilling a well, the bit having a cone, a nose, a shoulder, and a gage, having a bit body, at least one fixed blade cutter depending downwardly from the bit body, at least one frustoconical rolling cutter mounted for rotation on a bit leg depending downwardly from the bit body in one of the nose and shoulder, a plurality of cutting elements arranged on a leading edge of the at least one fixed blade cutter wherein one of the plurality of cutting elements on the leading edge of the fixed blade is located at or within about 0.040 inch of a central axis of rotation of the bit body and wherein the plurality of cutting elements are disposed in parallel with at least one row of back-up cutters arranged between a leading edge of the at least one fixed blade cutter and a trailing edge of the at least one fixed blade cutter, and a plurality of cutting elements arranged on the at least one frustoconical rolling cutter, the method comprising:

defining an aggressiveness of the bit as a function of penetration rate of the bit during drilling to weight-on-bit during drilling; and adjusting the aggressiveness of the bit by one or more methods selected from the group consisting of:

adjusting the angular distance between each frustoconical rolling cutter and each fixed blade cutter, wherein each frustoconical rolling cutter is truncated in length;

adjusting the effective projection between at least two adjacent cutting elements on a frustoconical rolling cutter;

arranging the cutting elements of the at least one fixed-blade cutter and cutting elements of the at least one frustoconical rolling-cutter so that one of the rolling-cutter and the fixed blade cutter leads the other; and arranging the cutting elements of the at least one fixed-blade cutter and the cutting elements of the at least one frustoconical rolling-cutter on an opposing rolling cutter and fixed blade cutter so that the cutting elements of the at least one fixed-blade cutter and cutting elements of the at least one rolling-cutter fall in the same kerf during drilling operations, wherein the cutting elements of the frustoconical rolling cutter are arranged to lead the cutting elements on the fixed blade cutter which is angularly spaced apart from the rolling cutter approximately 180 degrees;

wherein the aggressiveness is further defined by the position of the at least one row of back-up cutters with respect to the leading edge of the at least one fixed blade cutter.

13. A hybrid earth-boring drill bit having at least one fixed blade and at least one rolling cutter, the bit comprising:

a bit having a bit body having a centerline as the axis of rotation of the bit body, having at least one fixed blade attached to the bit body about the centerline, the at least one fixed blade having at least one row of a plurality of cutting elements arranged in a row on a leading edge of the blade and wherein the plurality of cutting elements are disposed in parallel with at least one row of back-up cutters arranged between a leading edge of the at least one fixed blade and a trailing edge of the at least one fixed blade, and having at least one frustoconical rolling cutter mounted for rotation on a bit leg secured to the bit body about the centerline;

at least one cutting element on the fixed blade arranged in a first position a first radial distance from the centerline of the bit body on a leading edge of the fixed blade; and a first cutting element on the frustoconical rolling cutter arranged in a first position a second radial distance from the centerline of the bit body on the rolling cutter to follow a cutting element arranged in the first position at the first radial distance on the leading edge of the fixed blade, wherein the frustoconical rolling cutter is truncated in length, wherein on at least one of the rows of cutting elements on one of the at least one fixed blade, a cutting element on the fixed blade is located at or within about 0.040 inch of the central axis of rotation of the bit body, and wherein the cutting elements of the frustoconical rolling cutter are arranged to lead the cutting elements on the fixed blade cutter which is angularly spaced apart from the rolling cutter approximately 180 degrees.

14. The hybrid bit of claim 13, wherein the axis of rotation of the at least one rolling cutter intersects the centerline axis of rotation of the bit body.

15. The hybrid bit of claim 13, further comprising: a second cutting element on the at least one rolling cutter at a second radial distance from the centerline of the bit body to follow the cutting element arranged in the first position at the first radial distance on the leading edge of the at least one fixed blade.

16. The hybrid bit of claim 15, wherein one of the first cutting element and the second cutting element attached to the at least one rolling cutter are located on the at least one rolling cutter so that each of the first cutting element and the second cutting element independently engages during cutting a formation using the hybrid bit.

17. The hybrid bit of claim 15, wherein each of the first cutting element and the second cutting element attached to the at least one rolling cutter are located on the at least one rolling cutter so that each of the first cutting element and the second cutting element simultaneously engages during cutting a formation using the hybrid bit.

18. The hybrid bit of claim 13, wherein the first radial distance and the second radial distance are selected from the group consisting of the same distance from the centerline of the bit body, different distances from the centerline of the bit body, and approximately the same distance from the centerline of the bit body.

19. The hybrid bit of claim 13, further comprising:

at least one other cutting element arranged in a second position a second radial distance from the centerline of the bit body on a leading edge of the fixed blade;

at least one other cutting element on the rolling cutter arranged in a second position a second radial distance from the centerline of the bit body on the rolling cutter mounted on a bit leg secured to the bit body to follow a cutting element arranged in a second position on the leading edge of the fixed blade.

20. A hybrid bit having at least one fixed blade and at least one rolling cutter, the bit comprising:

a bit body having a centerline as the axis of rotation of the bit body, having at least one frustoconical rolling cutter truncated in length and mounted for rotation on a bit leg secured to the bit body, and having at least one fixed blade attached to the bit body;

at least one cutting element on the rolling cutter arranged in a first position a first radial distance from the centerline of the bit body on the frustoconical rolling cutter mounted on a bit leg secured to the bit body; and at least one cutting element arranged in a first position at the first radial distance from the centerline of the bit body on a leading edge of the fixed blade to follow a cutting element arranged in a first position on the on the rolling cutter and at least one other cutting element arranged at a distance from the centerline of the bit body, wherein the at least one cutting element and the at least one other cutting element are disposed in parallel with at least one row of back-up cutters arranged between the leading edge of the at least one fixed blade cutter and a trailing edge of the at least one fixed blade, wherein one of the at least one fixed blades further includes a cutting element on the leading edge of the fixed blade, the cutting element being located at or within about 0.040 inch of the axis of rotation of the bit body, and wherein the cutting elements of the frustoconical rolling cutter are arranged to lead the cutting elements on the fixed blade cutter which is angularly spaced apart from the rolling cutter approximately 180 degrees.

21. The hybrid bit of claim 20, further comprising:

another cutting element on the rolling cutter arranged in a first position at the first radial distance from the centerline of the bit body on the rolling cutter mounted on a bit leg secured to the bit body.

22. The hybrid bit of claim 21, further comprising:

at least one cutting element arranged in a second position a second radial distance from the centerline of the bit body on the rolling cutter; and at least one cutting element in a second position at the second radial distance from the centerline of the bit body on the fixed blade to follow a cutting element arranged in at the second position at the second radial distance from the centerline of the bit body on the rolling cutter.

23. A hybrid bit having at least two fixed blades and at least one rolling cutter located therebetween, the hybrid bit comprising:

a bit having a bit body having a centerline as the axis of rotation of the bit body, having a first fixed blade attached to the bit body, and having a frustoconical rolling cutter truncated in length and mounted for rotation on a bit leg secured to the bit body located a first angular location*distance after the first fixed blade, and having a second fixed blade attached to the bit body a second angular rotation distance greater than the first angular rotation distance after the rolling cutter;

at least one cutting element arranged in a first position a first radial distance from the centerline of the bit body on a leading edge of the first fixed blade and at least one other cutting element arranged at a distance from the centerline of the bit body, wherein the at least one cutting element and the at least one other cutting element are disposed in parallel with at least one row of back-up cutters arranged between the leading edge of the first fixed blade and a trailing edge of the first fixed blade;

at least one cutting element on the frustoconical rolling cutter arranged in at the first position a first radial distance from the centerline of the bit body on the rolling cutter mounted on a bit leg secured to the bit body to follow a cutting element arranged in at the first position on the leading edge of the fixed blade; and at least one cutting element arranged in a first position at the first radial distance from the centerline of the bit body on a leading edge of the second fixed blade, wherein one of the two fixed blades further includes a cutting element on the leading edge of said fixed blade, the cutting element being located at or within about 0.040 inch of the axis of rotation of the bit body, and wherein the cutting elements of the frustoconical rolling cutter are arranged to lead the cutting elements on the fixed blade cutter which is angularly spaced apart from the rolling cutter approximately 180 degrees.

24. A hybrid earth-boring drill bit having at least two fixed blades and at least two rolling cutters, the bit comprising:

a bit body having a centerline as the axis of rotation of the bit body, the at least two fixed blades attached to the bit body approximately equally spaced about the centerline axis of rotation of the bit body and having at least two frustoconical rolling cutters each truncated in length and mounted for rotation on a bit leg secured to the bit body approximately equally spaced about the centerline axis of rotation of the bit body and at least one row of back-up cutters arranged between a leading edge of the at least two fixed blades and a trailing edge of the at least two fixed blades;

at least one cutting element at a first radial distance from the centerline of the bit body on each fixed blade of the at least two fixed blades and at least one other cutting element arranged at a distance from the centerline of the bit body, wherein the at least one cutting element and the at least one other cutting element are disposed in parallel with the at least one row of back-up cutters; and at least one cutting element at the first radial distance from the centerline of the bit body on each frustoconical rolling cutter of the at least two frustoconical rolling cutters, wherein one of the at least two fixed blades further includes a cutting element on the leading edge of said fixed blade, the cutting element being located at or within about 0.040 inch of the axis of rotation of the bit body, and wherein the cutting elements of the frustoconical rolling cutter are arranged to lead the cutting elements on the fixed blade cutter which is angularly spaced apart from the rolling cutter approximately 180 degrees.

25. The hybrid bit of claim 24, wherein each cutting element attached at the first radial distance from the centerline axis of the bit body on each fixed blade leads the cutting element attached at the first radial distance on a rolling cutter of the at least two rolling cutters.

26. The hybrid bit of claim 24, wherein each cutting element attached at the first radial distance from the centerline axis of the bit body on each fixed blade follows a cutting element attached at the first radial distance on a rolling cutter of the at least two frustoconical rolling cutters.

27. The hybrid bit of claim 24, wherein each cutting element attached at the first radial distance from the centerline axis of the bit body on each rolling cutter of the at least two rolling cutters leads the cutter attached at the first radial distance from the centerline axis of the bit body on each fixed blade cutter of the at least two fixed blade cutters.

28. A hybrid bit having at least two fixed blades and at least two rolling cutters, the hybrid bit comprising:

a bit body having a centerline as the axis of rotation of the bit body, having at least two fixed blades attached to the bit body and at least two frustoconical rolling cutters each truncated in length and mounted for rotation on a bit leg secured to the bit body, each rolling cutter of the at least two frustoconical rolling cutters secured to the bit body spaced approximately opposite about the centerline of a fixed blade of the at least two fixed blades;

at least one cutting element at a first radial distance from the centerline of the bit body on each fixed blade of the at least two fixed blades at least one other cutting element arranged at a distance from the centerline of the bit body, wherein the at least one cutting element and the at least one other cutting element are disposed in parallel with and at least one row of back-up cutters arranged between a leading edge the at least two fixed blade and a trailing edge of the at least two fixed blades; and at least one cutting element at the first radial distance from the centerline of the bit body on each rolling cutter of the at least two rolling cutters, wherein one of the at least two fixed blades further includes a cutting element on the leading edge of said fixed blade, the cutting element being located at or within about 0.040 inch of the axis of rotation of the bit body, and wherein the cutting elements of the frustoconical rolling cutter are arranged to lead the cutting elements on the fixed blade cutter which is angularly spaced apart from the rolling cutter approximately 180 degrees.

29. The hybrid bit of claim 28, wherein the each rolling cutter of the at least two frustoconical rolling cutters comprises a rolling cutter secured to the bit body spaced an angular distance closer about the centerline of the axis of rotation of the bit body to a centerline of the fixed blade leading the frustoconical rolling cutter of the at least two fixed blades.

30. The hybrid bit of claim 28, further comprising:

another cutting element at a first radial distance from the centerline of the bit body on each rolling cutter of the at least two rolling cutters.

31. The hybrid bit of claim 28, further comprising: one of the cutting elements attached to the rolling cutter of the at least two rolling cutters located a distance from the another cutting element so that each of the cutting elements independently engages a formation during drilling using the hybrid bit.

32. The hybrid bit of claim 28, further comprising:

each of the cutting elements attached to the rolling cutter of the at least two rolling cutters located so that at least two of cutting elements simultaneously engages a formation during drilling using the hybrid bit.

33. The hybrid bit of claim 28, wherein the at least one cutting element of each fixed blade of the at least two fixed blades extends a distance from the fixed blade a distance less that the at least one cutting element on each rolling cutter of the at least two rolling cutters extends from each rolling cutter.

34. A hybrid earth-boring drill bit comprising:

a bit body having a centerline as the axis of rotation of the bit body, having three fixed blades attached to the bit body and three frustoconical rolling cutters each truncated in length and mounted for rotation on a bit leg secured to the bit body, each frustoconical rolling cutter spaced between two fixed blades and approximately opposite about the centerline of one fixed blade of the three fixed blades;

at least one cutting element at a first radial distance from the centerline of the bit body on the first fixed blade of the three fixed blades and at least one other cutting element arranged at a distance from the centerline of the bit body, wherein the at least one cutting element and the at least one other cutting element are disposed in parallel with at least one row of back-up cutters arranged between a leading edge of the first fixed blade and a trailing edge of the first fixed blade;

at least one cutting element at the first radial distance from the centerline of the bit body on the first rolling cutter of the three rolling cutters located approximately opposite of the bit body from the first fixed blade;

at least one cutting element at a second radial distance from the centerline of the bit body on the second fixed blade of the three fixed blades;

at least one cutting element at the second radial distance from the centerline of the bit body on the second rolling cutter of the three frustoconical rolling cutters located approximately opposite of the bit body from the second fixed blade;

at least one cutting element at a third radial distance from the centerline of the bit body on the third fixed blade of the three fixed blades; and at least one cutting element at the third radial distance from the centerline of the bit body on the third rolling cutter of the three frustoconical rolling cutters located approximately opposite one the bit body from the third fixed blade, wherein one of the at least three fixed blades further includes a cutting element on the leading edge of said fixed blade, the cutting element being located at or within about 0.040 inch of the axis of rotation of the bit body, and wherein the cutting elements of at least one of the frustoconical rolling cutters are arranged to lead the cutting elements on the fixed blade cutter which is angularly spaced apart from the rolling cutter approximately 180 degrees.

35. The method of claim 34, wherein the each rolling cutter of the three rolling cutters comprises a rolling cutter secured to the bit body spaced an angular distance closer about the centerline of the axis of rotation of the bit body to a centerline of a fixed blade leading the rolling cutter of the at least two fixed blades.

36. A method of varying a cutting rate of a bit used during drilling a well, the bit having a bit body, at least one fixed blade cutter depending downwardly from the bit body wherein one of a plurality of cutting elements arranged in a row on a leading edge of the at least one fixed blade is located at or within about 0.040 inch of a central axis of rotation of the bit body and wherein the plurality of cutting elements are disposed in parallel with at least one row of back-up cutters arranged between a leading edge of the at least one fixed blade cutter and a trailing edge of the at least one fixed blade cutter, at least one frustoconical rolling cutter mounted for rotation on a bit leg depending downwardly from the bit body, and a plurality of cutting elements arranged on a leading edge of the at least one fixed blade cutter, and a plurality of cutting elements arranged on the at least one rolling cutter, the method comprising:

defining an aggressiveness of the bit as a function of penetration rate of the bit during drilling to weight-on-bit during drilling; and adjusting the aggressiveness of the bit by one or more methods selected from the group consisting of:

adjusting the angular distance between each frustoconical rolling cutter and each fixed blade cutter, wherein each frustoconical rolling cutter is truncated in length;

adjusting the effective projection between at least two adjacent cutting elements on a frustoconical rolling cutter;

arranging the cutting elements of the at least one fixed-blade cutter and cutting elements of the at least one frustoconical rolling-cutter so that one of the frustoconical rolling-cutter and the fixed blade cutter leads the other; and arranging the cutting elements of the at least one fixed-blade cutter and the cutting elements of the at least one frustoconical rolling-cutter on an opposing frustoconical rolling cutter and fixed blade so that the cutting elements of the at least one fixed-blade cutter and cutting elements of the at least one frustoconical rolling-cutter fall in the same kerf during drilling operations, the cutting elements of the frustoconical rolling cutter being one of leading the fixed blade cutter (<180°) angular distance), the frustoconical rolling cutter opposes the fixed blade cutter (=180°) angular distance), or trails the fixed blade) cutter (>180°) angular distance); and wherein the aggressiveness is further defined by the position of the at least one row of back-up cutters with respect to the leading edge of the at least one fixed blade cutter.

37. A method for varying cutting aggressiveness of a hybrid bit having at least one fixed blade cutter and at least one rolling cutter, the method comprising:

forming a bit having a bit body having a centerline as the axis of rotation of the bit body, having at least one fixed blade cutter attached to the bit body about the centerline wherein one of a plurality of cutting elements arranged in a row on a leading edge of the fixed blade is located at or within about 0.040 inch of the axis of rotation of the bit body and wherein the plurality of cutting elements are disposed in parallel with at least one row of back-up cutters arranged between a leading edge of the fixed blade cutter and a trailing edge of the fixed blade cutter, and having at least one frustoconical rolling cutter truncated in length and mounted for rotation on a bit leg secured to the bit body about the centerline, the angle between the fixed blade cutter and the at least one frustoconical rolling cutter being any angle other than ninety degrees;

attaching at least one cutting element arranged in a first position a first radial distance in the cone of the hybrid bit from the centerline of the bit body on a leading edge of the fixed blade cutter; and attaching a first cutting element on the frustoconical rolling cutter arranged in a first position a second radial distance from the centerline of the bit body on the rolling cutter mounted on a bit leg secured to the bit body to follow a cutting element arranged in a first position on the leading edge of the fixed blade cutter, the second radial distance from the centerline of the bit body being in at least one of the nose and the shoulder of the hybrid bit, wherein the cutting elements of the rolling cutter are arranged to lead the cutting elements on the fixed blade cutter which is angularly spaced apart from the rolling cutter approximately 180 degrees.

38. The method of claim 37, further comprising:

attaching a second cutting element on the at least one rolling cutter at a second position at a second radial distance from the centerline of the bit body on the at least one rolling cutter mounted on a bit leg secured to the bit body to follow the cutting element arranged in a first position on the leading edge of the fixed blade cutter.

39. The method of claim 38, further comprising:

spacing one of the first cutting element and the second cutting element attached to the at least one rolling cutter so that only one of the first cutting element and the second cutting element engages independently during cutting a formation using the hybrid bit.

40. The method of claim 37, further comprising:

spacing each of the first cutting element and the second cutting element attached to the at least one rolling cutter so that each of the first cutting element and the second cutting element has a portion thereof engaging simultaneously during cutting a formation using the hybrid bit.

41. The method of claim 37, wherein the first radial distance and the second radial distance are selected from the group consisting of the same distance from the centerline of the bit body, different distances from the centerline of the bit body, and approximately the same distance from the centerline of the bit body.

42. The method of claim 37, further comprising:

attaching at least one cutting element arranged in a second position a second radial distance from the centerline of the bit body on a leading edge of the fixed blade cutter;

attaching at least one cutting element on the frustoconical rolling cutter arranged in a second position a second radial distance from the centerline of the bit body on the rolling cutter mounted on a bit leg secured to the bit body to follow the cutting element arranged in a second position on the leading edge of the fixed blade cutter.

43. The method of claim 42, further comprising:

attaching another cutting element on the rolling cutter arranged in a first position a first radial distance from the centerline of the bit body on the rolling cutter mounted on a bit leg secured to the bit body to follow the cutting element arranged in a first position on the leading edge of the fixed blade cutter; and attaching an additional cutting element on the rolling cutter arranged in a second position a second radial distance from the centerline of the bit body on the rolling cutter mounted on a bit leg secured to the bit body to follow the cutting element arranged in a second position on the leading edge of the fixed blade cutter.

44. A hybrid bit having at least one fixed blade cutter and at least one rolling cutter, the bit comprising:

a bit having a bit body having a centerline as the axis of rotation of the bit body, having at least one fixed blade cutter attached to the bit body about the centerline, wherein one of a plurality of cutting elements arranged in a row on a leading edge of the fixed blade is located at or within about 0.040 inch of the axis of rotation of the bit body and wherein the plurality of cutting elements are disposed in parallel with at least one row of back-up cutters arranged between a leading edge of the at least one fixed blade cutter and a trailing edge of the at least one fixed blade cutter, and having at least one frustoconical rolling cutter mounted for rotation on a bit leg secured to the bit body about the centerline, the angle between the fixed blade cutter and the at least one frustoconical rolling cutter being any angle other than ninety degrees;

at least one cutting element arranged in a first position a first radial distance in the cone of the hybrid bit from the centerline of the bit body on a leading edge of the fixed blade cutter; and a first cutting element on the frustoconical rolling cutter arranged in a first position a second radial distance from the centerline of the bit body on the frustoconical rolling cutter mounted on a bit leg secured to the bit body to follow a cutting element arranged in a first position on the leading edge of the fixed blade cutter, the second radial distance from the centerline of the bit body being in at least one of the nose and the shoulder of the hybrid bit and outboard of the cone of the hybrid bit, wherein the frustoconical rolling cutter is truncated in length, wherein the cutting elements of the frustoconical rolling cutter are arranged to lead the cutting elements on the fixed blade cutter which is angularly spaced apart from the rolling cutter approximately 180 degrees.

45. A hybrid bit having at least one fixed blade cutter and at least one rolling cutter, the hybrid bit having a cone, nose, and shoulder, the hybrid bit comprising:

a bit having a bit body having a centerline as the axis of rotation of the bit body, having at least one fixed blade cutter attached to the bit body about the centerline, and having at least one frustoconical rolling cutter truncated in length and mounted for rotation on a bit leg secured to the bit body about the centerline;

at least one cutting element arranged in a first position a first radial distance in the cone of the hybrid bit from the centerline of the bit body on a leading edge of the fixed blade cutter and at least one other cutting element arranged at a distance from the centerline of the bit body, wherein the at least one cutting element and the at least one other cutting element are disposed in parallel with at least one row of back-up cutters arranged between a leading edge of the at least one fixed blade cutter and a trailing edge of the at least one fixed blade cutter; and a first cutting element on the frustoconical rolling cutter arranged in a first position a second radial distance from the centerline of the bit body on the rolling cutter mounted on a bit leg secured to the bit body to follow a cutting element arranged in a first position on the leading edge of the fixed blade cutter, the second radial distance from the centerline of the bit body being in at least one of the nose and the shoulder of the hybrid bit and outboard of the cone of the hybrid bit, wherein the at least one of the fixed blade cutters comprises a cutting element arranged on the leading edge of the fixed blade and located at or within about 0.040 inch of the centerline of the bit body, and wherein the cutting elements of the frustoconical rolling cutter are arranged to lead the cutting elements on the fixed blade cutter which is angularly spaced apart from the rolling cutter approximately 180 degrees.

46. The hybrid bit of claim 45, wherein the at least one rolling cutter is located in one of the nose and or the shoulder of the hybrid bit.

* * * * *